US010004973B2

(12) United States Patent
Weatherby et al.

(10) Patent No.: US 10,004,973 B2
(45) Date of Patent: Jun. 26, 2018

(54) AUTOMATED HELMET GAS BLADDER MAINTENANCE SYSTEM AND METHOD

(71) Applicant: Michael T. Weatherby, Ventnor, NJ (US)

(72) Inventors: Michael T. Weatherby, Ventnor, NJ (US); Scott M. Slomowitz, Glen Mills, PA (US); Jason C. Zerweck, Media, PA (US); William R. Horan, Jr., Elkins Park, PA (US)

(73) Assignee: Michael T. Weatherby, Ventnor, NJ (US)

( * ) Notice: Subject to any disclaimer, the term of this patent is extended or adjusted under 35 U.S.C. 154(b) by 0 days. days.

(21) Appl. No.: 15/833,516

(22) Filed: Dec. 6, 2017

(65) Prior Publication Data

US 2018/0104565 A1 Apr. 19, 2018

Related U.S. Application Data

(60) Division of application No. 15/494,998, filed on Apr. 24, 2017, now Pat. No. 9,868,046, which is a division (Continued)

(51) Int. Cl.
*A63B 71/10* (2006.01)
*A63B 71/08* (2006.01)

(Continued)

(52) U.S. Cl.
CPC ..... *A63B 71/081* (2013.01); *A42B 3/0433* (2013.01); *A42B 3/122* (2013.01); *A63B 2225/305* (2013.01)

(58) Field of Classification Search
CPC ..... A42B 3/0406; A42B 3/0433; A42B 3/122; A42B 3/046; A63B 71/081; F04B 49/065; F04D 27/00; G06F 11/321; G06F 11/3089
See application file for complete search history.

(56) References Cited

U.S. PATENT DOCUMENTS 3,999,220 A 12/1976 Keltner
4,035,846 A * 7/1977 Jencks ..... A42B 3/122 2/413

(Continued)

FOREIGN PATENT DOCUMENTS

WO WO 2012/094733 7/2012

OTHER PUBLICATIONS

International Search Report for corresponding PCT Application No. PCT/US2016/032860 dated Aug. 26, 2016.

*Primary Examiner* — Reinaldo Sanchez-Medina
(74) *Attorney, Agent, or Firm* — Caesar Rivise, PC

(57) ABSTRACT

A system and method for easily and frequently checking the gas bladder pressure levels in a sports player's helmet and refilling them to maintain optimum head protection for the player. The system and method involve an electronic hand-held gas pump that wirelessly communicates with an adjacent wireless device that comprises a software application for controlling pump operation. The software application allows a user to build a player helmet profile that automatically displays current gas pressure in the gas bladder to which the pump is currently connected. The system and method establish a preferred gas pressure level for every bladder in the helmet when the helmet is being worn and when the helmet is not being worn. Spreadsheets for an entire team can be generated, not only depicting the preferred gas pressure levels but time/date data for periodic checks in order to maintain every bladder to its preferred gas pressure level.

19 Claims, 27 Drawing Sheets

Related U.S. Application Data of application No. 15/278,445, filed on Sep. 28, 2016, now Pat. No. 9,661,890, which is a continuation of application No. PCT/US2016/032860, filed on May 17, 2016.

(60) Provisional application No. 62/318,851, filed on Apr. 6, 2016, provisional application No. 62/168,250, filed on May 29, 2015.

(51) Int. Cl.
*A42B 3/04* (2006.01)
*A42B 3/12* (2006.01)

(56) References Cited

U.S. PATENT DOCUMENTS 4,566,137 A 1/1986 Gooding
4,872,492 A 10/1989 McNally et al.
5,156,145 A 10/1992 Flood et al.
5,245,989 A 9/1993 Simon
5,257,470 A 11/1993 Auger et al.
5,263,203 A * 11/1993 Kraemer ..... A42B 3/122 2/413
5,353,459 A * 10/1994 Potter ..... A43B 13/206 12/146 R
5,429,166 A 7/1995 Anzai et al.
5,846,063 A 12/1998 Lakic
5,916,664 A 6/1999 Rudy
5,937,462 A 8/1999 Huang
6,069,326 A 5/2000 Henson et al.
6,226,801 B1 5/2001 Alexander et al.
6,446,270 B1 9/2002 Durr
6,591,428 B2 * 7/2003 Halstead ..... A42B 3/122 2/413
6,826,509 B2 11/2004 Crisco, III et al.
6,966,220 B2 11/2005 Yueh
7,017,195 B2 3/2006 Buckman et al.
7,111,491 B2 9/2006 Kosh et al.
7,184,866 B2 2/2007 Squires et al.
7,526,389 B2 4/2009 Greenwald et al.
7,879,417 B2 2/2011 Rudy
8,127,373 B1 3/2012 Fodemski
8,418,713 B2 4/2013 Huang
8,554,509 B2 10/2013 Crisco, III et al.
8,602,855 B2 12/2013 Turner
8,845,754 B2 * 9/2014 Streeter ..... A61F 2/68 602/13
8,860,570 B2 10/2014 Thomas et al.
9,648,914 B2 * 5/2017 Duncan ..... A41D 13/018
9,661,890 B2 5/2017 Weatherby et al.
9,868,046 B2 1/2018 Weatherby et al.
2004/0123643 A1 * 7/2004 Kosh ..... G01L 27/005 73/1.64
2007/0226881 A1 * 10/2007 Reinhard ..... A42B 3/065 2/412
2010/0026809 A1 2/2010 Curry
2012/0053442 A1 3/2012 Sjaaheim et al.
2012/0210498 A1 8/2012 Mack
2012/0223833 A1 9/2012 Thomas et al.
2012/0297525 A1 11/2012 Bain
2012/0304367 A1 * 12/2012 Howard ..... A42B 3/046 2/413
2013/0060168 A1 * 3/2013 Chu ..... A42B 3/046 600/595
2013/0118255 A1 5/2013 Callsen et al.
2013/0167290 A1 7/2013 Ben Ezra
2013/0232667 A1 9/2013 Leon
2014/0000011 A1 1/2014 Johnson
2014/0159912 A1 * 6/2014 Fraden ..... A61B 5/002 340/870.02
2014/0371607 A1 * 12/2014 Fitzsimmons ..... A61B 5/0004 600/499
2015/0040285 A1 2/2015 Mobayyen
2016/0128415 A1 * 5/2016 Tubbs ..... A42B 3/205 2/424
2016/0143383 A1 * 5/2016 Allen ..... A42B 3/0486 2/413

* cited by examiner

AUTOMATED HELMET GAS BLADDER MAINTENANCE SYSTEM AND METHOD

CROSS REFERENCE TO RELATED APPLICATIONS

This Divisional application claims priority under 35 U.S.C. § 121 of application Ser. No. 15/494,998 filed on Apr. 24, 2017 which in turn is a Divisional application and claims priority under 35 U. S.C. § 121 of application Ser. No. 15/278,445 filed on Sep. 28, 2016 (now U.S. Pat. No. 9,661,890) which is a bypass continuation application that claims priority under 35 U.S.C. § 120 of International Application PCT/US2016/032860 filed on May 17, 2016 which in turn claims the benefit under 35 U. S.C. § 119(e) of application Ser. No. 62/168,250 filed on May 29, 2015 and application Ser. No. 62/318,851 filed on Apr. 6, 2016 and all of which are entitled AUTOMATED HELMET AIR BLADDER MAINTENANCE SYSTEM AND METHOD, and all of whose entire disclosures are incorporated by reference herein.

BACKGROUND OF THE INVENTION

The present invention relates to protective headgear of the type used in athletic events by participants and more particularly to protective adjustable headgear used in football.

Football is an aggressive contact sport and the need to protect football players from all kinds of injuries, especially head injuries, such as concussions, is paramount. In order to provide the optimum protection against head injuries, the helmet of a football player needs to fit each player properly.

As shown in FIGS. 1A-1C, conventional football helmets 1 (such as those sold by Riddell, Schutt, etc.,) comprise gas pads or gas bladders (a plurality 2 of which are shown most clearly in FIG. 1B) inside the helmet 1 that can be inflated via respective valves 3 by coupling a hose 4 via an inflation needle 5 (FIG. 1C) to the valves 3. These valves 3 are similar to the valves used in footballs that receive an inflation needle therein in order to inflate the football. As is also well-known, the proximal end of these inflation needles comprises a threaded portion for connection to a mating threaded fitting on the hose end.

Although there are a number of air bladder combinations that can be used (see for example, U.S. Pat. No. 6,226,801 (Alexander, et al.), which is incorporated by reference in its entirety and which discloses a football helmet having air pads or air bladders therein), a typical plurality of football air bladders comprises a front air bladder, a crown air bladder, an orbital air bladder, back/side air bladders, a left jaw air bladder and a right jaw air bladder. When these properly-inflated air bladders are used in combination with the helmet's chin strap, these components ensure that a snug fit around the player's head is achieved when the helmet is worn during play. For example, a player's helmet size could be a medium, large, extra-large, etc. By way of example only, for helmet manufacturer Riddell, a head circumference in "Varsity," ranging from adolescents to young adults, bases its sizes of up to 20⅜" as a small, between 20⅜" and 22" as a medium, between 22" and 23½" as a large and 23½" and larger considered extra-large with custom larger helmets also being available. For youth football, there are smaller dimensions that the helmet sizes are based off of.

However, these air bladders 2 are usually inflated when they are first distributed to the football player and it is then up to the player to decide whether to ever refill or even check the fill state of each bladder. Furthermore, when the helmet is first fitted to the player, it is simply done by "feel" of the player, i.e., once the helmet "feels comfortable" no more air is pumped into the various air bladders.

Such a scenario is potentially dangerous to the player because it is well-known that a player's helmet loses air after every play, series, quarter, game, practice, etc., not to also mention that other variables such as time, weather and altitude can also affect the fill level of each air bladder. Therefore, leaving it up to the football player to periodically check the "feel" of the helmet fit is not a reliable and safe way to ensure that player's helmet is always providing the optimum protection to the player.

It should be noted that the bladders are typically filled with air, although other kinds of gases can be used. As such, use of the word "air" or the phrase "air bladder" throughout this Specification is not meant to limit these bladders to only air but it is implied that any conventional and safe gas that can replace the use of "air" within the bladder is covered by the present invention.

Thus, there remains a need for a system and method that easily and frequently checks the air bladder levels in the player's helmet and automatically fills each air bladder to a specified pressure that provides the optimum protection of the helmet for each player.

All references cited herein are incorporated herein by reference in their entireties.

BRIEF SUMMARY OF THE INVENTION

A system for establishing and maintaining gas (e.g., air, etc.) pressure levels within a plurality of gas bladders of a sports helmet (e.g., a football helmet, etc.) is disclosed. The system comprises: an electronically-controlled pneumatic pump including a gas pressure sensor. The pump further comprises coupling means (e.g., an inflation needle, a hose and an inflation needle, etc.) for connecting to valves of the plurality of gas bladders; and a wireless device (smartphone, computer tablets, etc.) that communicates with the electronically-controlled pneumatic pump, the wireless device further comprises a display for permitting an operator to control the operation of the pump via the wireless device to measure the gas pressure of each bladder and to alter the gas pressure level within each bladder to restore the gas pressure level to a respective predetermined preferred level.

A method for establishing and maintaining air pressure levels within a plurality of gas bladders of a sports helmet (e.g., a football helmet, etc.), wherein each bladder has a respective valve, is disclosed. The method comprises: (a) providing an electronically-controlled pneumatic pump including a gas pressure sensor and further including coupling means (e.g., an inflation needle, a hose and an inflation needle, etc.) for connecting to valves of the plurality of gas bladders; (b) positioning a wireless device, having a display, in close proximity to the electronically-controlled pneumatic pump to establish communication between the pump and the wireless device; (c) activating a user interface on the wireless device for identifying the sports helmet whose gas bladders are to be monitored or filled and to associate the selected helmet with a respective player; (d) coupling the coupling means to a particular one of the plurality of valves instructed by the user interface; (e) operating the pump, via the user interface, to establish a preferred gas pressure level within the one of the plurality of gas bladders; (f) storing the preferred gas pressure level of the one of the plurality of bladders within the wireless device by associating the preferred gas pressure level with the particular bladder, player and helmet along with the date and time of the operating of the pump.

A system for establishing and maintaining gas pressure levels within a plurality of gas bladders of a sports helmet (e.g., a football helmet, etc.) is disclosed. The system comprises an electronically-controlled pneumatic pump including a wireless communication interface and a gas pressure sensor, wherein the pump further comprises coupling means (e.g., an inflation needle, a hose and an inflation needle, etc.) for connecting to valves of the plurality of gas bladders, the electronically-controlled pneumatic pump further comprising a display for permitting an operator to control the operation of the pump via the display to measure the gas pressure of each bladder, establish a respective preferred gas pressure level within each bladder and to periodically restore gas pressure in each bladder to its preferred gas pressure level, wherein the pump stores the respective preferred gas pressure levels for the helmet.

A method for establishing and maintaining air pressure levels within a plurality of gas bladders of a sports helmet, wherein each bladder having a respective valve, is disclosed. The method comprises: (a) providing an electronically-controlled pneumatic pump having a display and including a wireless communication interface and a gas pressure sensor and further including coupling means (e.g., an inflation needle, a hose and an inflation needle, etc.) for connecting to valves of the plurality of gas bladders; (b) activating a user interface of the pump for identifying the sports helmet whose gas bladders are to be monitored or filled and to associate the selected helmet with a respective player; (c) coupling the coupling means to a particular one of the plurality of valves instructed by the user interface; (d) operating the pump, via the user interface, to establish a preferred gas pressure level within the one of the plurality of gas bladders; (e) storing the preferred gas pressure level of the one of the plurality of bladders within the wireless device by associating the preferred gas pressure level with the particular bladder, player and helmet along with the date and time of the operating the pump.

BRIEF DESCRIPTION OF SEVERAL VIEWS OF THE DRAWINGS

Many aspects of the present disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views.

DETAILED DESCRIPTION OF THE PREFERRED EMBODIMENTS

Figure 1A:
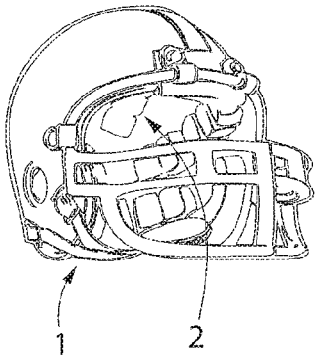
FIG. 1A (PRIOR ART)
FIG. 1A is an isometric view of an exemplary prior art football helmet.
Figure 1B:
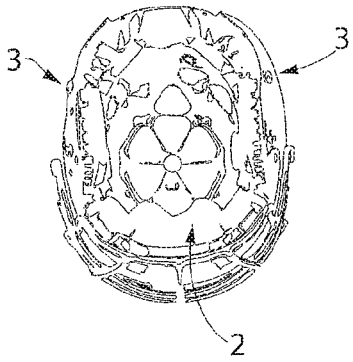
FIG. 1B (PRIOR ART)
FIG. 1B is an internal view of the football helmet of FIG. 1A showing a plurality of air pads or air bladders therein.
Figure 1C:
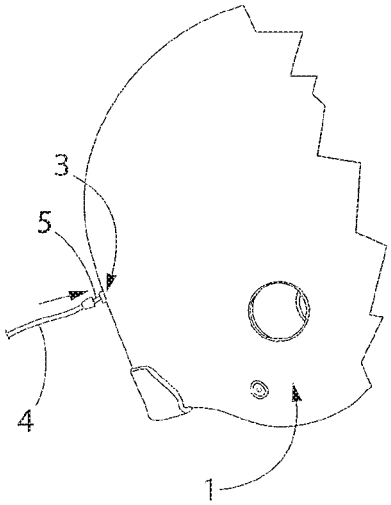
FIG. 1C (PRIOR ART)
FIG. 1C is a partial view of another exemplary prior art football helmet showing an air hose coupled to one of the valves of the air bladders in the football helmet.

Referring now to the figures, wherein like reference numerals represent like parts throughout the several views, exemplary embodiments of the present disclosure will be described in detail. Throughout this description, various components may be identified having specific values, these values are provided as exemplary embodiments and should not be limiting of various concepts of the present invention as many comparable sizes and/or values may be implemented.

Application Ser. No. 62/168,250 filed May 29, 2015 entitled "Automated Helmet Air Bladder Maintenance System and Method" is incorporated by reference in its entirety. Application Ser. No. 62/318,851 filed Apr. 6, 2016 also entitled "Automated Helmet Air Bladder Maintenance System and Method" is also incorporated by reference in its entirety. It should be further understood that the present invention is preferably directed to gas bladders used in football helmets. However, it is within the broadest scope of the invention to include any helmet that utilizes gas bladders to fit properly on a wearer's head.

Figure 2:
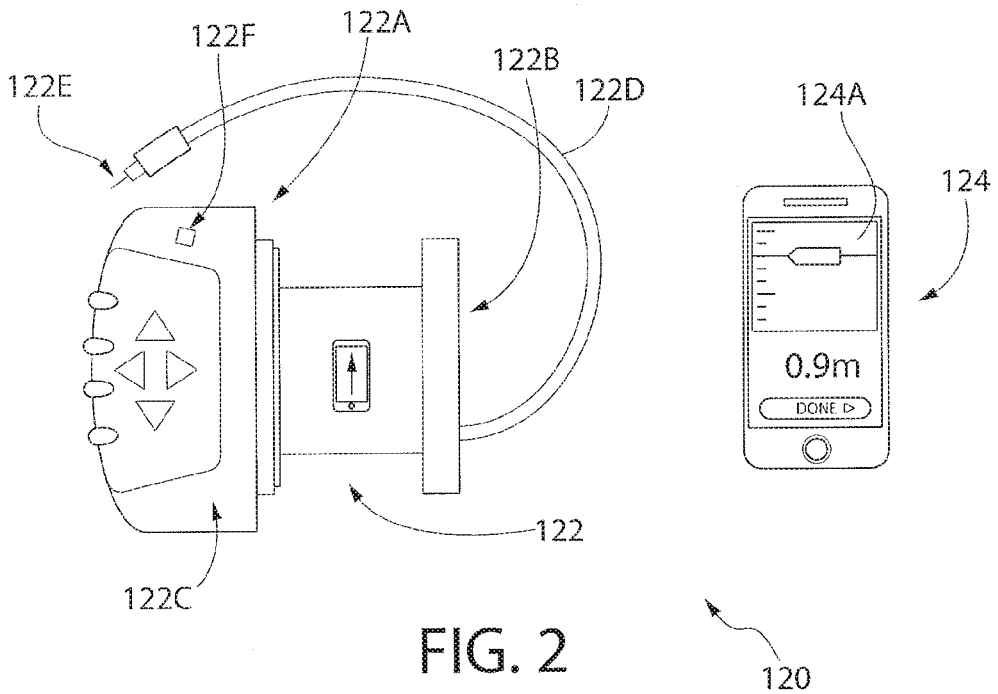
FIG. 2 is an exploded plan view of the present invention showing the helmet pump and cradle for receiving a wireless device therein.

FIG. 2 shows the key components of the first embodiment system 120 of the present invention. In particular, the system 120 comprises a hand-held electrical pump 122 having wireless (e.g., Bluetooth, Ultra Wideband, Induction Wireless, etc.) capability for communication 123 (see FIG. 2H) with a conventional wireless device 124 (e.g., a smartphone, a computer tablet, etc.) that is physically received within an adjustable wireless device cradle 122B. The wireless device 124 comprises a software application (as will be discussed in detail later) that permits the operator to interface with the pump 122 to effect helmet air bladder inflation and maintenance. The wireless device 124 comprises a touch screen display 124A that may include a variety of virtual buttons, keys and other icons that suffice for user input/output. It should be noted that it is within the broadest scope of the present invention that the wireless device 124 may also comprise a "hard" keypad as alternative, or in addition to, the touch screen display 124A. The important feature is the ability to provide user input/output at the wireless device 124.

Figure 2A:
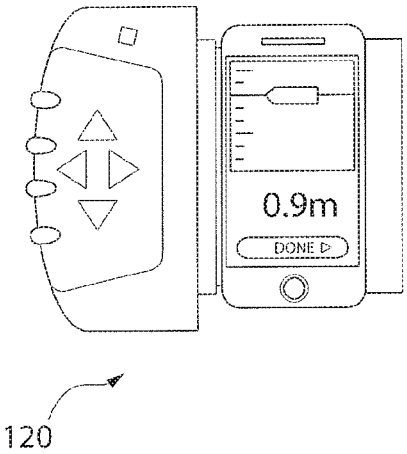
FIGS. 2A-2B depict alternative orientations for use of the present invention in either the left or right hand of the operator.
Figure 2B:
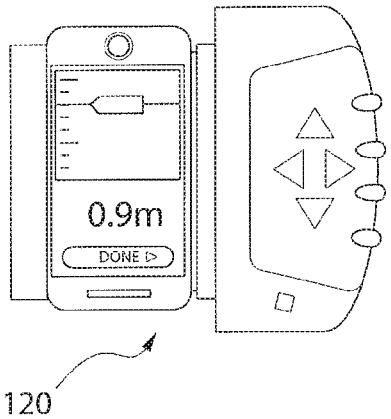
Figure 2C:
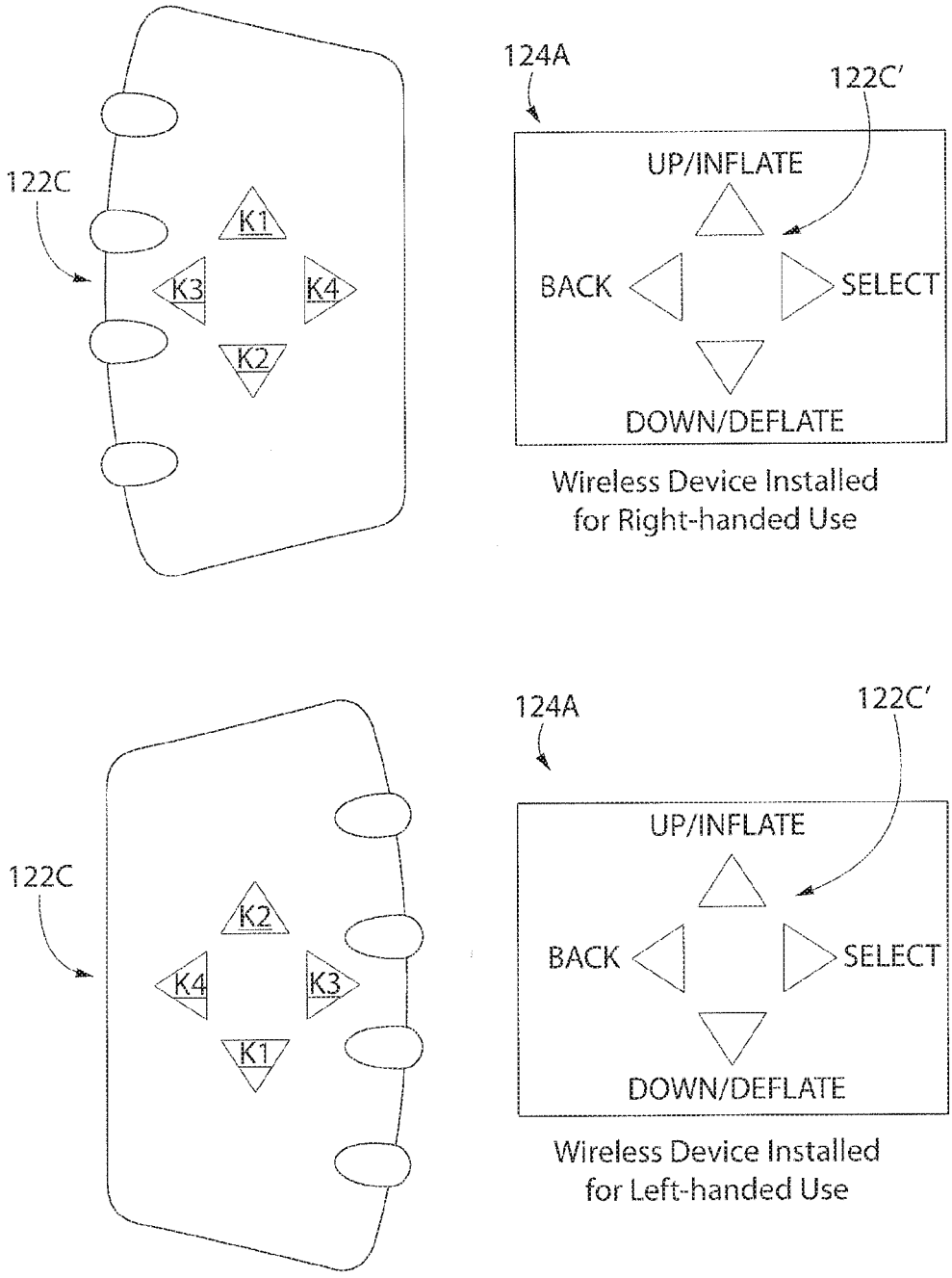
FIG. 2C shows the keypad of the pump as well as the corresponding display providing indicia for the keypad when the present invention is used in a right-handed orientation or a left-handed orientation.
Figure 2E:
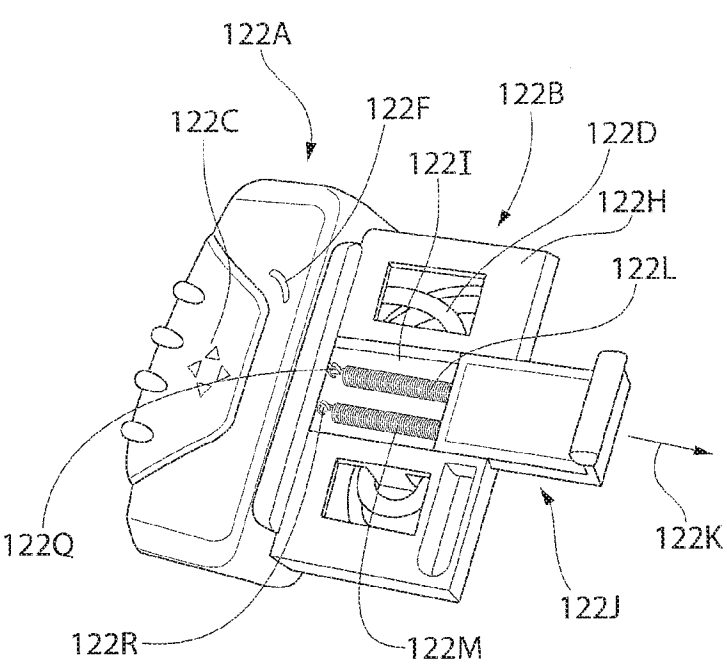
FIG. 2E is an isometric view of the front side of the present invention of FIG. 2D, depicting how the cradle can be adjusted to accommodate differently-sized wireless devices therein.
Figure 2D:
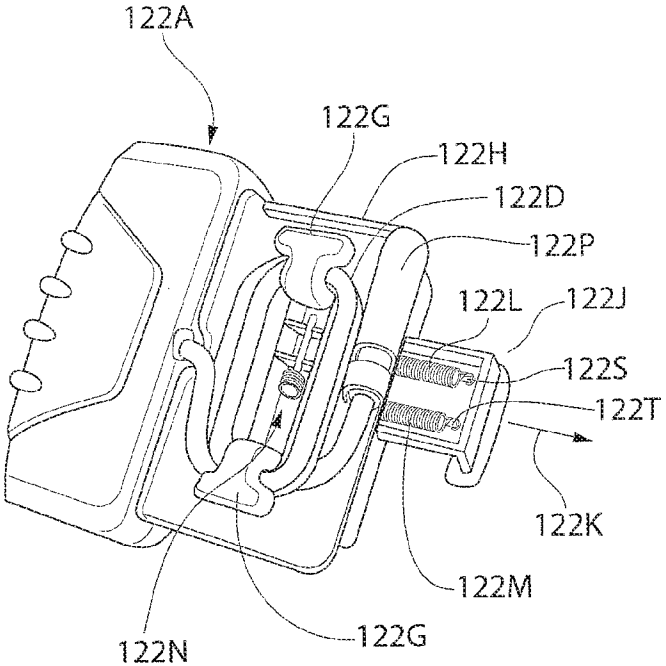
FIG. 2D is an isometric view of the reverse side of the present invention without the wireless device installed.
Figure 2F:
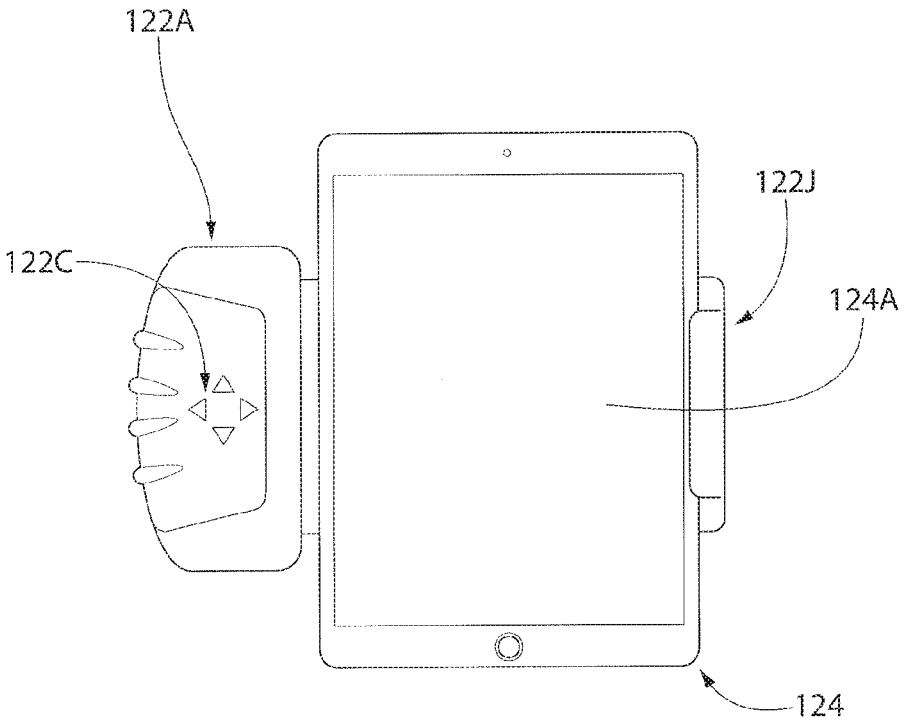
FIG. 2F is a plan view a computer tablet, by way of example only, installed in the cradle of the present invention.
Figure 2G:
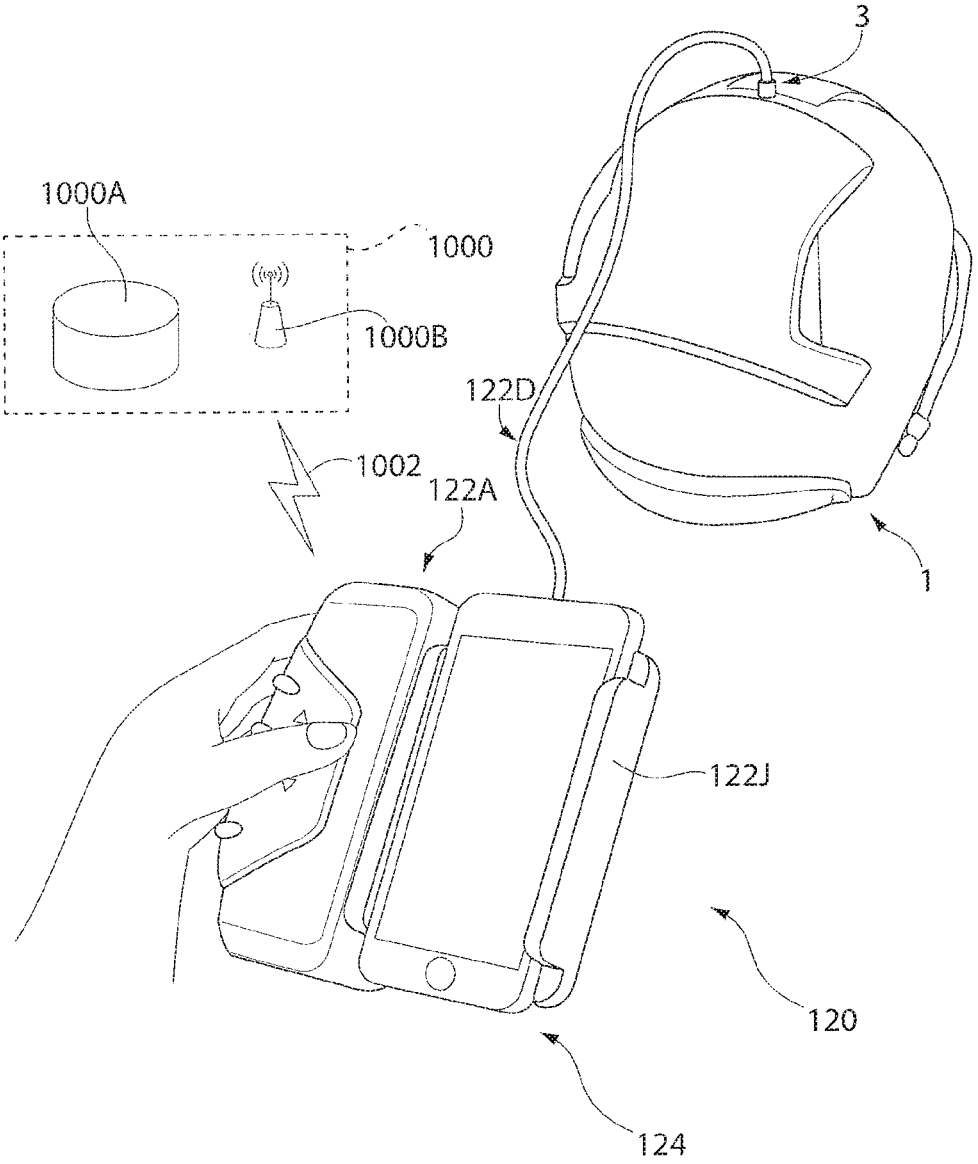
FIG. 2G is an isometric view showing the present invention being coupled to one bladder valve of a helmet to inflate the bladder appropriately while also depicting a remote database to which the wireless device may communicate helmet bladder data.
Figure 2H:
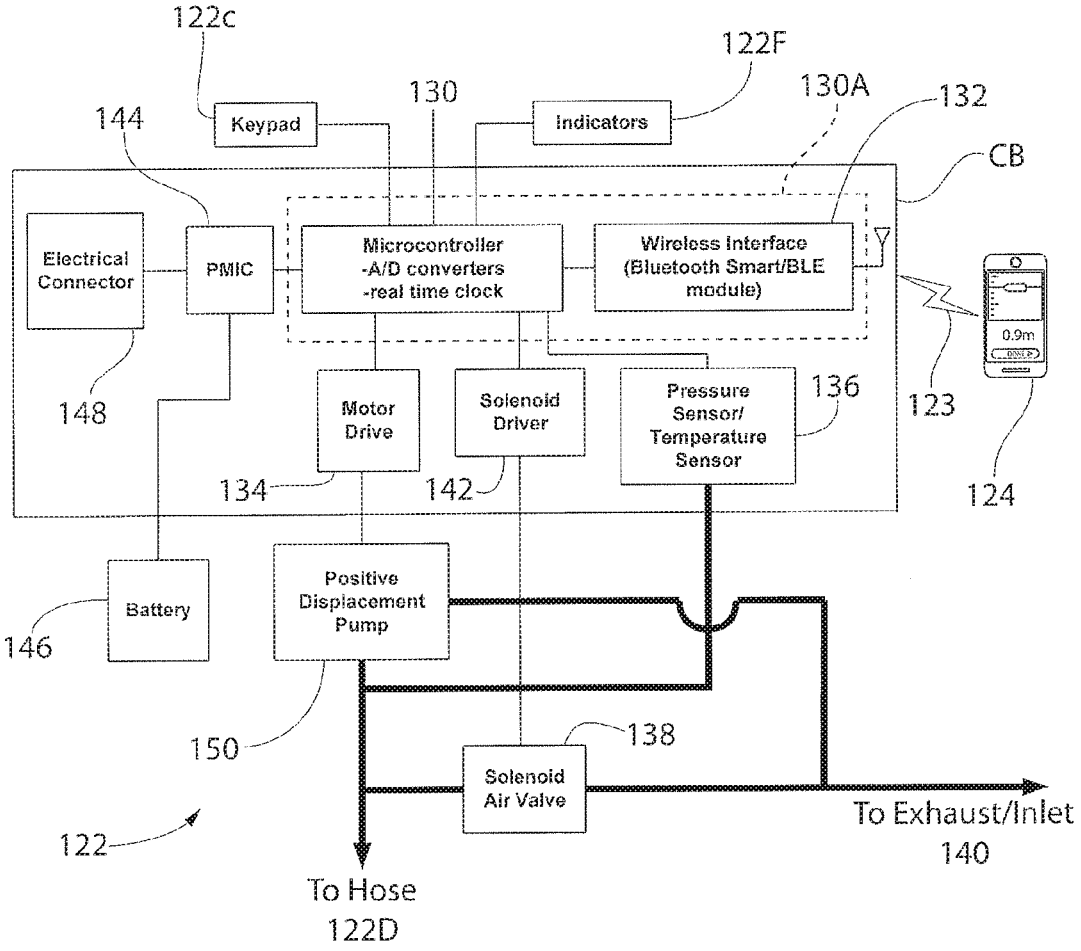
FIG. 2H is a block diagram of the electronically-controlled pneumatic pump of the present invention, with the heavy lines indicating pneumatic connections and the thinner lines indicating electrical connections.

The pump 122 comprises a housing 122A (e.g., an injection-molded pump enclosure) that contains the pump hardware and electronics (see FIG. 2H). A keypad 122C is included on the housing 122A that is used by the operator, in conjunction with the wireless device 124, to control the pump 122, as will also be discussed later. A pump hose 122D and related inflation needle 122E for inserting into the gas bladder valve 3 is pneumatically interfaced with the pump hardware. The pump hose 122D can be stowed on the back side of the cradle 122B for compactness (see FIG. 2D). Indicators (generally shown by reference number 122F) provide the operator with general purpose status (e.g., Bluetooth paring, pumping, key presses, battery status, etc.; these may comprise 1-2×LED indicators (RGB color)).

As shown in FIGS. 2A-2C, the present invention 120 utilizes the accelerometer function of the wireless device 124 to determine the labels to be associated with the keys K1-K4 on the keypad 122C. In particular, FIG. 2A depicts a "right-handed use" whereby the operator holds the pump 122 in his/her left hand and operates the keypad 122C using his/her right hand; conversely, FIG. 2B depicts a "left-handed use" whereby the operator holds the pump 122 in his/her right hand and operates the keypad 122C using his/her left hand. As shown most clearly in FIG. 2C, the keypad 122C itself has no labels; instead the labels appear in the corresponding display keypad 122C' on the wireless device touch screen 124A. The keys K1-K4 are hard-wired to a microcontroller 130 (see FIG. 2H, discussed later). The microcontroller 130 also receives a variable from the wireless device 124 indicative of the orientation of the wireless device display 124A. As such, depending on which key (K1-K4) is activated by the user and depending on the orientation of the display 124A, the microcontroller 130 is able to assign the function to be achieved by the depression of the particular key. As such, if the pump 122A and wireless device 124 are held in the orientation for right-handed use, depression of any key, K1-K4, will cause the microcontroller 130 to implement the function indicated in the display 124A. If, on the other hand, the pump 122A/wireless device 124 assembly are inverted as shown by the left-handed use orientation in FIG. 2C, the microcontroller 130 will implement the functions assigned to keys K1-K4 shown in the display 124A. As such, the upper key, whether its key K1 in the right-handed orientation, or key K2 in the left-handed orientation, the "upper-oriented" key will always implement an "up" or "inflate" function. The other keys K3-K4 operate similarly. Thus, no matter how the wireless device 124 is mounted within the cradle 122B, the keys of the keypad 122C always have the functions indicated, as shown in FIG. 2C. The keypad 122C (e.g., 4*x* tactile user interface buttons, momentary-on) is centered and symmetric such that the pump 122 can be held by the left or right hand.

FIGS. 2D-2E show the reverse side and front sides, respectively, of the present invention 120 without the wireless device 124 coupled thereto. In particular, as shown most clearly in FIG. 2E, the cradle 122B comprises a platform section 122H that couples to the pump housing 122A. The platform 122H comprises a raceway 1221 in which a displacement element 122J slides in order to permit the cradle 122B to accommodate differently-sized wireless devices 124. A pair of springs 122L/122M are secured within the raceway 1221 at their looped ends over platform hooks 122Q/122R and hooks 122S/122T on the displaceable element 122J (see FIG. 2D). To open the cradle 122B, or to release the wireless device 124 therefrom, the operator displaces the element 122J in the direction of the arrow 122K in opposition to the springs' 122L/122M bias; the spring-bias (e.g., 5 lbs. of spring force) then captures the right side of the wireless device 124 to hold the device securely in the cradle 122B. FIG. 2D shows the reverse side of the pump housing 122A and the cradle 122B. As can be seen, the reverse side of the cradle 122B also comprises air hose hooks 122G that permit the gas hose 122D to be wrapped therearound and, as such, stowed against the reverse side of the cradle 122B; a compartment 122P stores the inflation needle 122E therein. A spare inflation needle 122N is also stored in a portion on the back of the platform 122H, as shown in FIG. 2D.

FIG. 2F shows an alternative wireless device 124, i.e., a computer tablet, releasably secured within the cradle 122B, thereby demonstrating the versatility of the present invention 120 in that it is adjustable for a variety of wireless device sizes. Moreover, the wireless device cradle 122B comprises a modular subassembly that permits air hoses of different types to used and stowed against the reverse side of the cradle 122B but to also stow additional items, e.g., needle lubrication containers (not shown).

FIG. 2G shows the present invention 120 coupled to an example gas bladder valve 3 on a conventional football helmet and the operator using the invention 120 accordingly. It should be understood that the operator would connect consecutively to each air bladder valve 3 on the helmet 1 until all the bladders are filled properly. In addition, the present invention 120 may further comprise a remote database 1000 (e.g., iCloud, etc.) for storing and retrieving particular helmet gas bladder data for different players. For example, gas bladder data for every player may be remotely stored whereby the operator's wireless device 124 communicates 1002 with the remote database 1000 via the wireless link 1000B coupled to the database 1000A. The database 1000A not only stores/retrieves air bladder-related data but a variety of analytics can be performed on the air bladder data for not only optimizing the readiness of each player's helmet, but trends in player head injury, reduction in player head injuries, etc. All of this can then be transmitted back to the operator for display on his/her wireless device 124. By way of example only, each team may have an account and each player on the team have a sub-account with respective user logins/passwords, and various hierarchies, where the coaches may have administrative authority to enter each player's account. Thus, all of the bladder preferred levels, as well as all associated data, can be stored in respective player accounts or sub-accounts.

It should be further noted that, as will be discussed later, all of the data related to the team, players, the gas bladder preferred fill levels for each player's helmet, etc. can be stored in the software application of the wireless device 124, or it can be remotely-stored in the remote database 1000 and retrieved when required. All of this data can be organized by the software application into spreadsheets for the team, individual players, etc.

FIG. 2H is a block diagram of the electronic pump 122. The control portion of the electrical pump 122 is a microcontroller 130 (e.g., ARM Cortex M0) including analog-to-digital (A/D) converters and a real-time clock. The microcontroller 130 communicates with a wireless interface module 132 (e.g., Bluetooth Smart/BLE module) for communicating with the wireless device 124. It should be understood that the microcontroller 130 and wireless interface module 132 may comprise an integrated IC 130A, as indicated by the dotted line. The microcontroller 130 controls a motor driver 134 (e.g., a power field effect transistor (FET)) for activating and deactivating a positive displacement pump 150 (PDP, e.g., DC motor-operated, AJK-B1201 PDP). The pump 150 is controlled to a maximum pressure of 20 psi to prevent injuries to the head of the helmet wearer. The output of the PDP 150 is pneumatically coupled to the hose 122D (e.g., 12-24" length, ¼" diameter flexible hose) at a first end and the inflation needle 122E is coupled to the other hose 122D end (in a manner discussed previously with regard to the hose 4/inflation needle 5). With regard to the third embodiment (FIGS. 4A-4C) discussed later, the output of the PDP 150 is pneumatically coupled to the inflation needle 325 since no hose is used in that embodiment.

Furthermore, gas bladder pressure is monitored using a pressure sensor 136 (e.g., a combined absolute pressure and temperature sensor, with an onboard A/D converter, such as the TE Connectivity MS5637-02BA03 pressure/temperature sensor). The pressure sensor 136 is pneumatically coupled to the output of the PDP 150 and electrically coupled to the microcontroller 130. In addition, a gas valve 138 (a solenoid air valve, two position, one way; e.g., AJK-F0501 valve) is pneumatically coupled between the output of the PDP 150 and an exhaust/inlet 140. This valve 138 provides a path to vent air in case the pressure becomes too high in the helmet 1. The exhaust/inlet valve 140 is necessary so that air can be supplied to the pump 122, as well as relieving air from the pump casework when the solenoid air valve 138 is active; alternatively a hydrophobic vent may be used. The air valve 140 is activated/deactivated by a solenoid driver 142 (e.g., a power FET) which in turn is controlled by the microcontroller 130 to which the driver 142 is electrically coupled. The PDP 150 is also pneumatically-coupled to the exhaust/inlet valve 140.

The pump 122 also includes a power management integrated circuit (PMIC) 144 which includes circuitry for battery charging and voltage regulation of a battery 146 (e.g., rechargeable battery, such as 3.7 VDC, 2000 mah, Li-Ion 18650 battery). A power input 148 (e.g., a through-hole mount, USB connector, etc.) is coupled to the PMIC 144. The electronic portion of the pump 122 is located on a circuit board CB.

Figure 3:
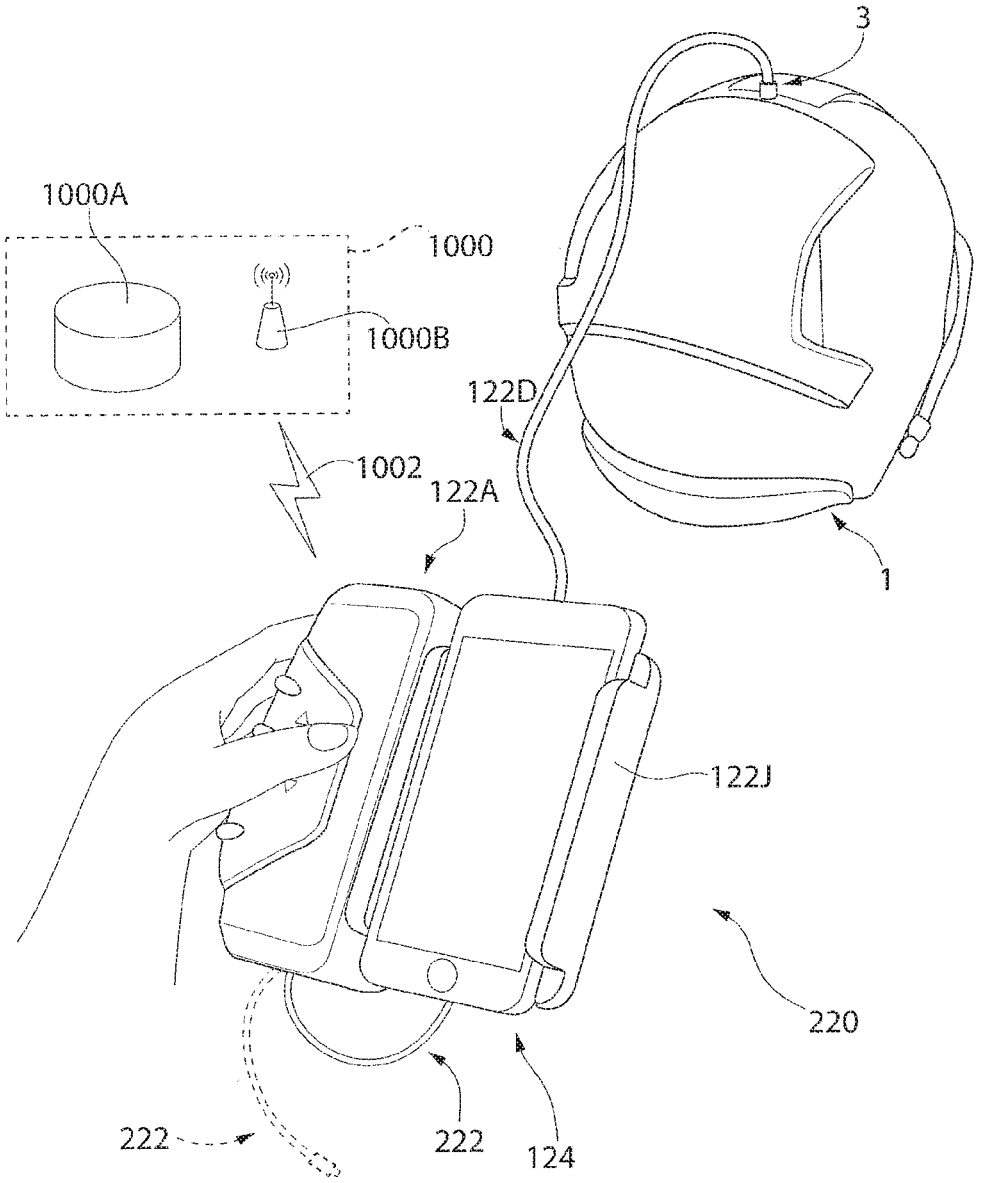
FIG. 3 is a second embodiment of the present invention wherein the electronically-controlled pneumatic pump forms a wired connection with the wireless device.
Figure 3A:
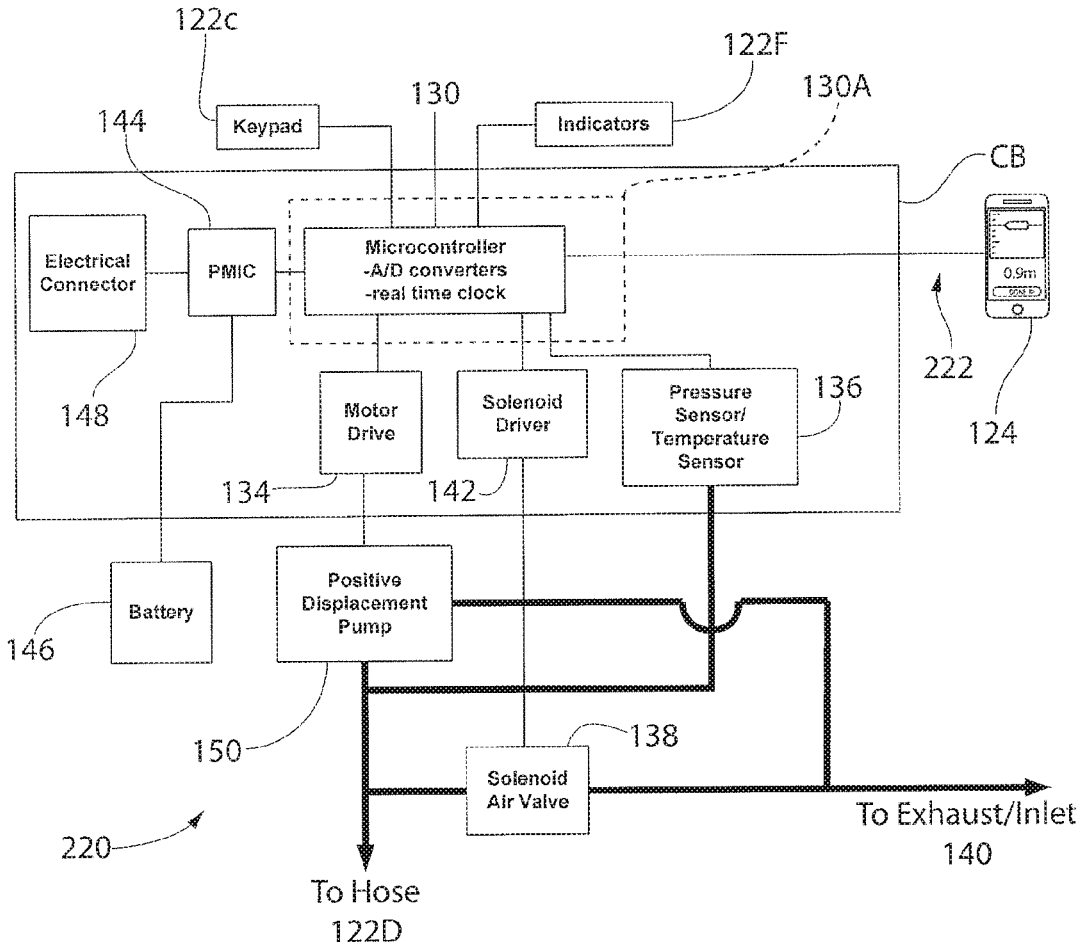
FIG. 3A is a block diagram of the electronically-controlled pneumatic pump of the second embodiment of the present invention, with the heavy lines indicating pneumatic connections and the thinner lines indicating electrical connections.

FIG. 3 depicts a second embodiment 220 of the present invention. In particular, the wireless interface between the pump 122 and the wireless device 124 is replaced with a wired connection (e.g., wire 222, such as an iPhone lightning cable, etc.). As a result, the pump 122 and the wireless device communicate over the wired connection 222. FIG. 3A depicts the block diagram of the second embodiment electronic pump 122. Other than the wired interface 222, the second embodiment 220 operates similarly to the first embodiment 120.

Figure 4A:
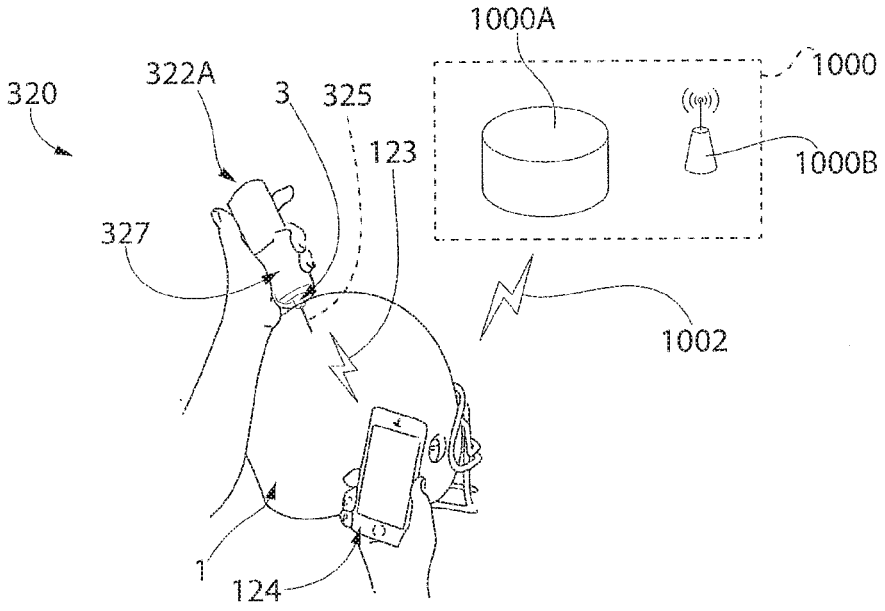
FIG. 4A is functional diagram of a third embodiment of the present invention that uses no hose and instead involves an inflation needle that protrudes from the electronically-controlled pneumatic pump.
Figure 4B:
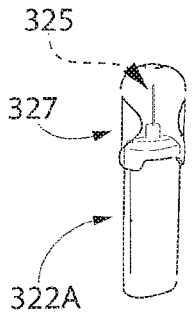
FIG. 4B depicts an inflation needle guard positioned over the inflation needle of the third embodiment when the pump is not in use.
Figure 4C:
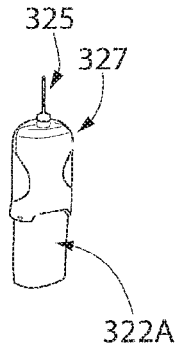
FIG. 4C depicts the inflation needle guard displaced away from the inflation needle of the third embodiment when the pump is ready to be coupled to the helmet valve via the inflation needle.

FIGS. 4A-4C depict a third embodiment 320 of the present invention. In the third embodiment 320, the hose 122D is eliminated and replaced with an inflation needle 325 that is coupled to the output of the positive displacement pump 150. As such, the pump portion 322A of the third embodiment 320 is manipulated to align the needle 325 with the valve 3 on the helmet 1 and inserted therein. The pump 322A is similar in all aspects to pump 122A except that no hose 122D is used and there is no keypad 122C on the pump 322A housing. As such, as is described below, virtual keys that appear on the wireless device 124 display are used to control the pump 322A. Furthermore, because the pump 322A needs to be manipulated in order to insert the inflation needle 325 into the valve 3, there is no cradle 122B. It should be noted that the inflation needle 325 is similar in operation to the inflation needle 122E of the first embodiment 120 but is longer since it forms the only passageway between the positive displacement pump 150 and the valve 3. In addition, to protect the inflation needle 325 when the pump 322A is not being used, a displaceable needle guard 327 is slidably positioned on the pump 322A. FIG. 4B shows the needle guard 327 deployed over the inflation needle 325 whereas FIG. 4C depicts the needle guard 327 displaced downward along the pump housing body to expose the inflation needle 325 for coupling to the port 3. Other than that, the third embodiment 320 operates similarly to the first embodiment 120.

Figure 5A:
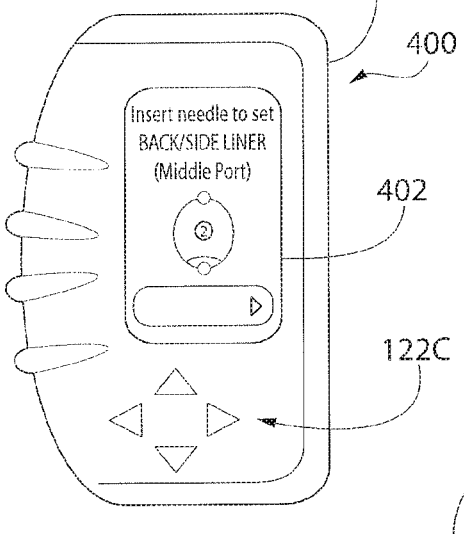
FIGS. 5A-5B depict the front and back sides, respectively, of a fourth embodiment of the present invention where no separate wireless device is used with the pump, but rather, the pump is integrated with a screen display and wireless communication.
Figure 5B:
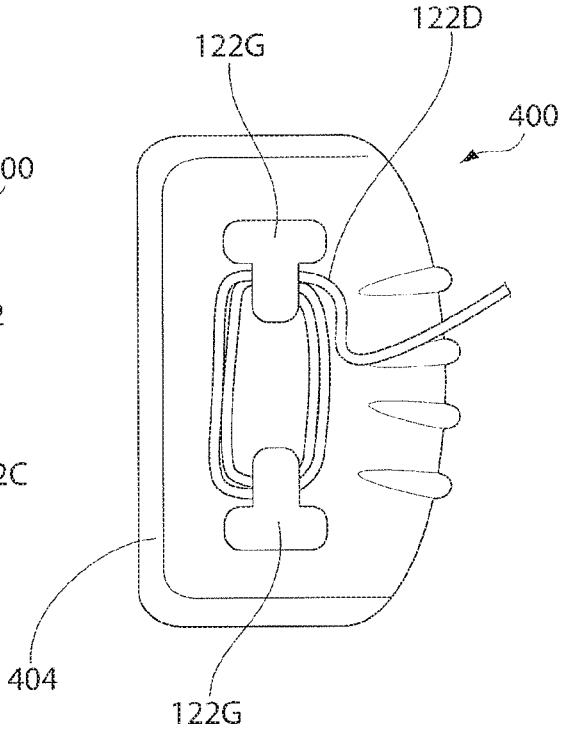
Figure 5C:
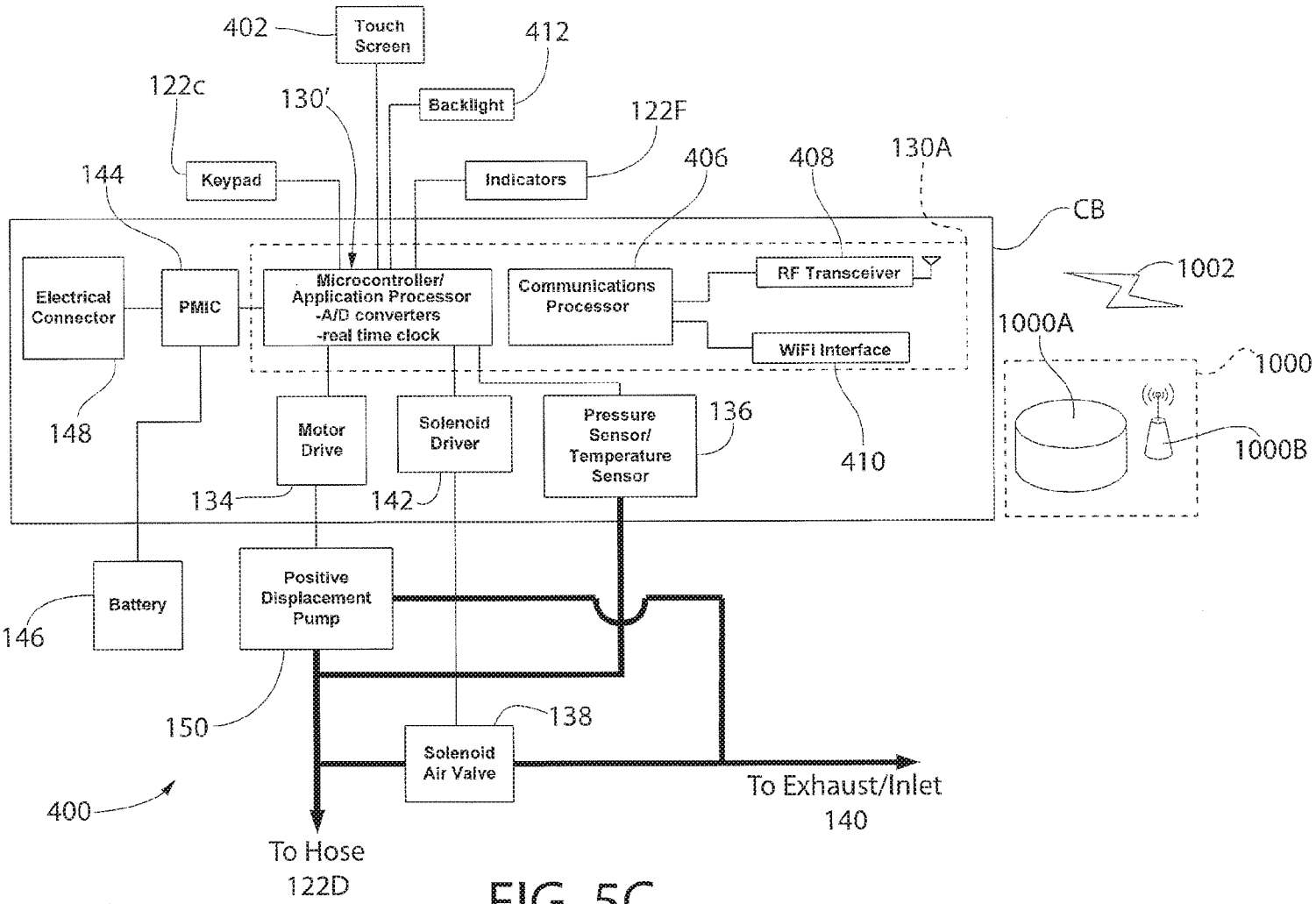
FIG. 5C is a block diagram of the integrated electronically-controlled pneumatic pump of FIGS. 5A-5B, with the heavy lines indicating pneumatic connections and the thinner lines indicating electrical connections.

A fourth embodiment 400 of the present invention is to eliminate the need for the wireless device 124. In particular, as shown in FIGS. 5A-5B, the pump 400 comprises a pump housing 404 having a display 402 and the keypad 122C. Unlike the first and second embodiments, the keypad 122C is not centered on the pump housing 404 in order to accommodate the display 402. FIG. 5C provides a block diagram of the pump 400 hardware that is similar to hardware of FIG. 2H except that the short range wireless interface module 132 is replaced with a communications processor 406 and RF transceiver 408 (including a WiFi interface 410) to replace the wireless device 124 communication capability, e.g., to the remote database 1000. In addition, the microcontroller 130' also functions as an application processor to support the user interface and control the touch screen 402 and backlighting 412 for the display 402. Furthermore, the microcontroller 130' includes the software application and controls the display 402 accordingly. As with the wireless device 124, the display 402 is a touchscreen, thereby allowing the operator to make selections and enter data as described earlier with regard to the previous embodiments. The reverse side of the pump housing 404 (FIG. 5B) includes the hose hooks 122G for stowing the air hose 122D. Unlike the first two embodiments, because there is no wireless device 124 used with the fourth embodiment, the keypad 122C does not reconfigure during use and thus keys K1-K4 do not change function based on orientation of the pump housing 404.

User Interface for Present Invention

The user interface of the present invention is now discussed. It should be understood that the user interface is operational in any of the previously disclosed embodiments. As such, the following detailed discussion of the user interface uses the first embodiment 120 only by way of example, it being understand that the software application is also applicable to the second, third and fourth embodiments.

As mentioned previously, the wireless device 124 comprises a software application that configures the device 124 for interaction with the pump 122. It should be understood that, as discussed below, the user interface prompts/instructs the operator on what to do. When the pump 122 is to be operated, the user interface may instruct the user to use the pump keypad 122C to effect an operation. Alternatively, as in the third 320 and fourth 400 embodiments, the virtual keys in the wireless device touch screen 124A or pump display touch screen 402, may also operate the pump 322A. Thus, the verb "control" is meant to convey the meaning that where the operator is being instructed by the user interface to use the keys on the keypad 122C, or the virtual keys 122C' (or any other virtual keys/icons shown in the touch screen display 124A/402), the user interface is considered "controlling" the pump 122A/220/322A/400 operation.

The software application comprises two functional modes: administrative and functional.

Figure 6:
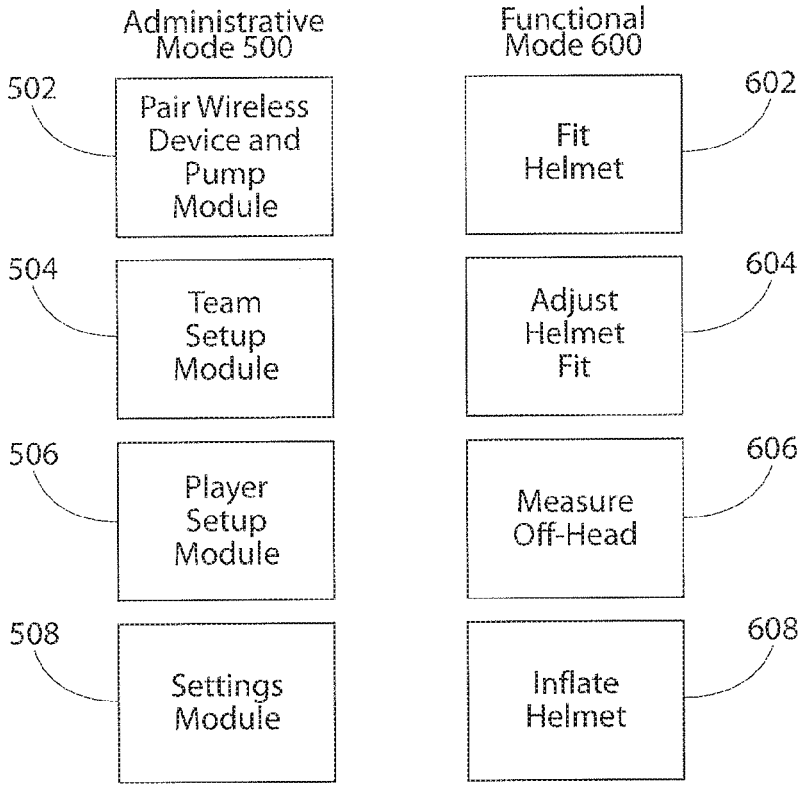
FIG. 6 sets forth the modules of the administrative mode and the functional mode of the software application that forms the user interface of the present invention.
Figure 6A:
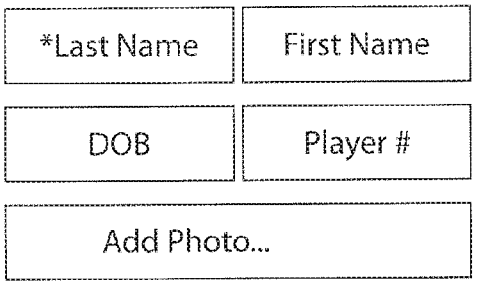
FIGS. 6A-6B depict some exemplary screen displays of the team setup module.
Figure 6B:
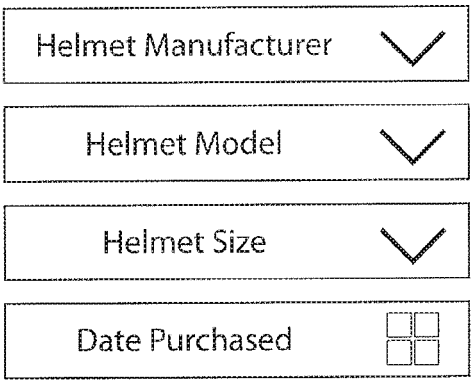
Figure 6C:
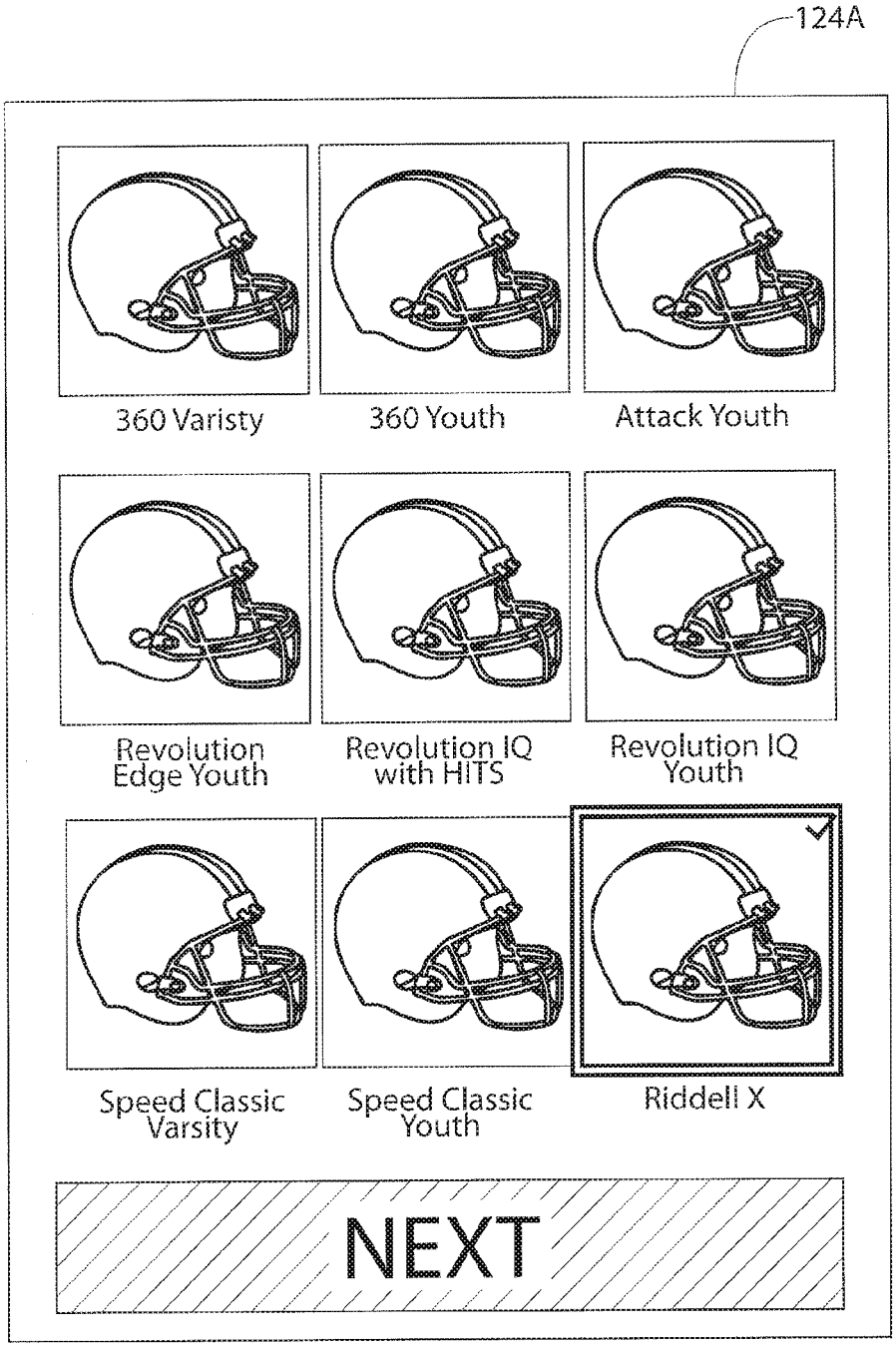
FIG. 6C depicts an exemplary screen display of a helmet manufacturer's helmet lines from which the operator can select.
Figure 6E:
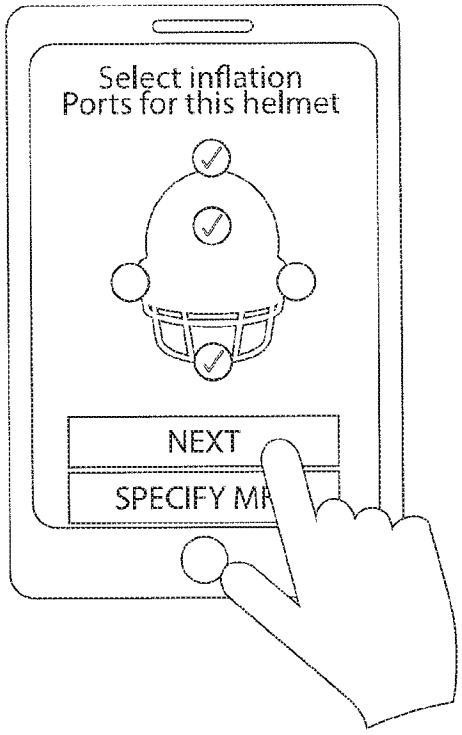
FIGS. 6D-6E depict exemplary screen displays of helmet selection and gas bladder configuration for that selected helmet.

The administrative mode 500 comprises a pair wireless device with pump module 502, a team setup module 504, a player setup module 506 and a settings module 508. The operator interacts with these modules using the wireless device 124 alone in the first, second and third embodiments; with respect to the fourth embodiment, the operator uses the display 402 to interact with these modules. In particular, the pairing module 502 prompts and guides the user through the pairing process so that the wireless device 124 and the pump 122 communicate with each other. The team setup module 504 and the player setup module 506 basically provide for data entry pertinent to the team or individual player. By way of example only, the team setup module 504 or the player setup module 506 may comprise data fields such as those shown in FIGS. 6A-6B that permit the operator to add a team player and then to enter pertinent information about the player. As shown in FIG. 6B, those modules also permit the operator to enter particular data about a player's helmet. The user is provided with a plurality of manufacturer's football helmets to choose from (see FIG. 6C) and can select which particular helmet is about to be checked/filled (viz., in this case the Ridell X model football helmet has been selected). In particular, entry of the player's particular helmet causes the software application to generate a graphic (FIG. 6D) which identifies the particular air bladder/valve configuration for that helmet. Thus, as can be seen FIG. 6E, the graphic informs the operator of the particular air valve locations (i.e., "1", "2" and "3") for that manufacturer's helmet; the graphic even indicates where no air valve (i.e., "NA" for "not applicable"-see FIG. 6D) is present that may be present in other manufacturer's helmets.

Figure 6D:
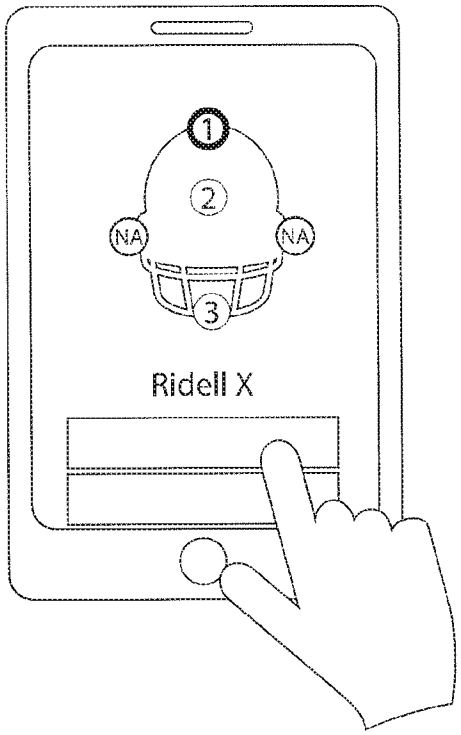

It should be understood that the software application comprises the details of the various football helmet manufacturers' air bladder ports and thereby generates the graphic of FIG. 6D. In addition, should a new helmet come on the market whose gas valve locations are not available in the software application, the software application comprises a function that allows the operator to enter each gas valve location for that "new helmet" and thereby store those locations for that helmet, as shown most clearly in FIG. 6E.

The settings module 508 is a catch-all module that includes such functions as user login/logout, reminder preferences or any other type of user customizable settings.

The functional mode 600 effects the actual air bladder inflation and helmet adjustments. The fit helmet module 602 and the adjust helmet module 604 are used to initially set the player's helmet to his or her optimal respective air bladder settings; the fit helmet module 602 is a linear process that steps the operator through each air bladder to ensure none are missed. Once the respective air bladder settings are saved for a particular player's helmet, any subsequent maintenance of the air bladders is accomplished using the measure off-head module 606 or the inflate helmet module 608.

Fit Helmet Module 602

Figure 7A:
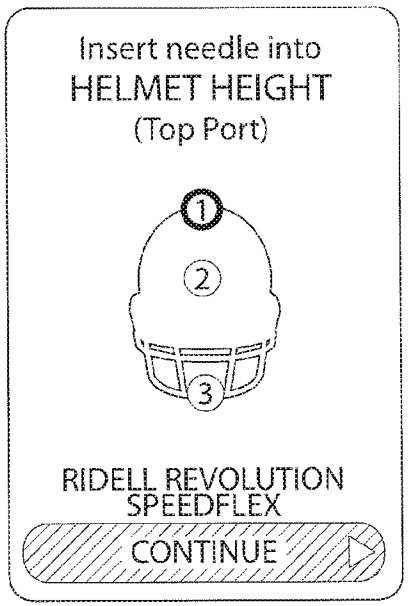
FIGS. 7-7L depict a series of exemplary screen displays used in the fit helmet module for configuring the preferred bladder fill level for each bladder in a particular player's helmet.
FIGS. 7M-7P depict a series of exemplary screen displays used in the adjust helmet module that permits an operator to adjust a particular one or more bladder fill levels after using the fit helmet module sequence.
FIGS. 7Q-7T depict a series of exemplary screen displays used in the measure off-head module that permits an operator to quickly determine the fill levels of each player's helmet without making the player wear the helmet.
FIGS. 7U-7Z depict exemplary screen displays used in the inflate helmet module that permit the operator to re-fill each player's helmet either with the player wearing the helmet ("inflate on-player") or with the player not-wearing the helmet ("inflate off-player")
Figure 7:
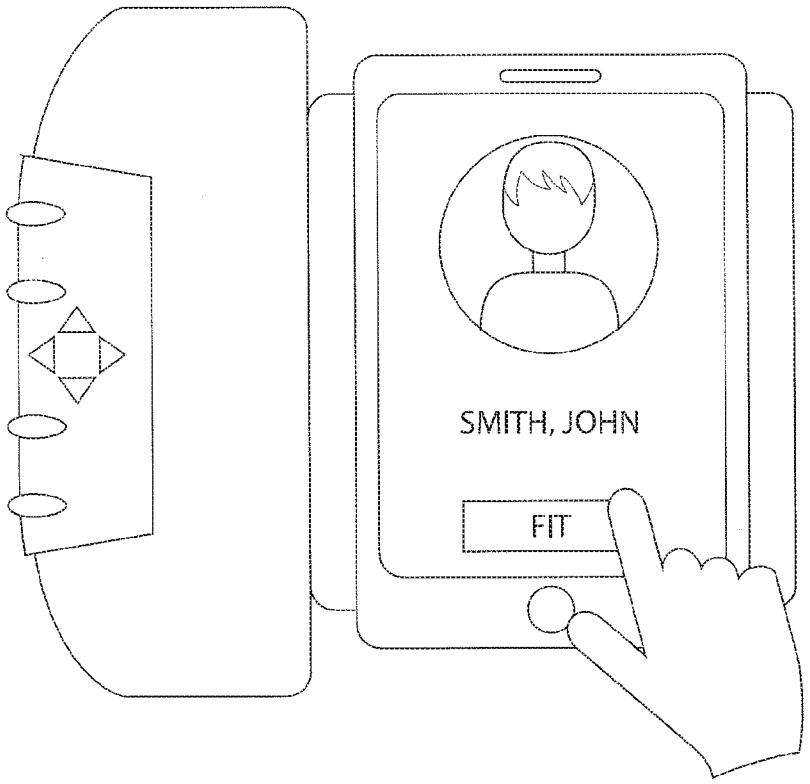
Figure 7C:
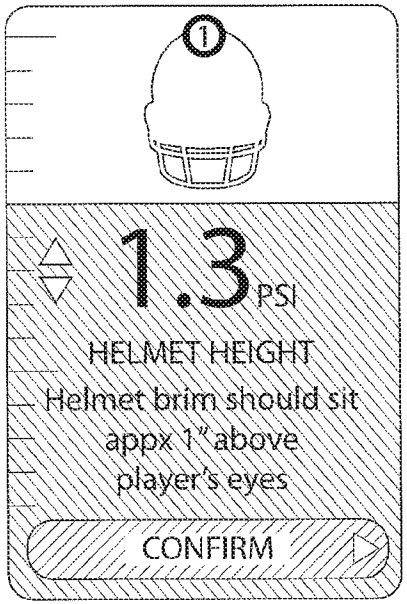
Figure 7B:
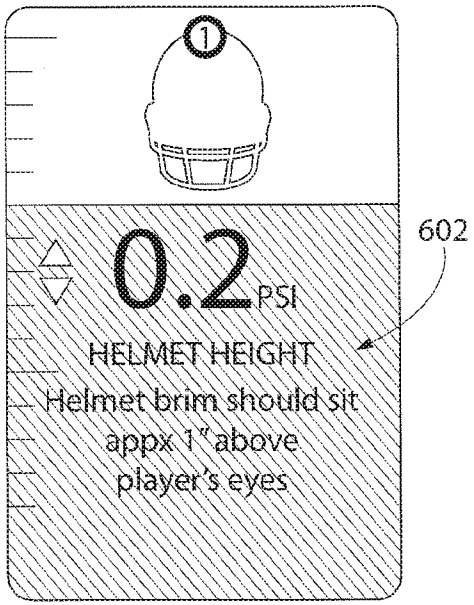
Figure 7D:
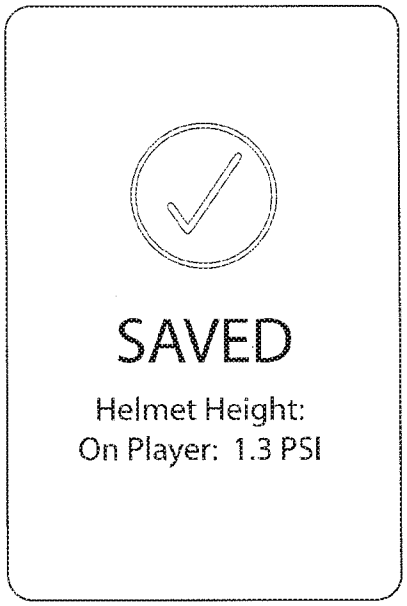
Figure 7E:
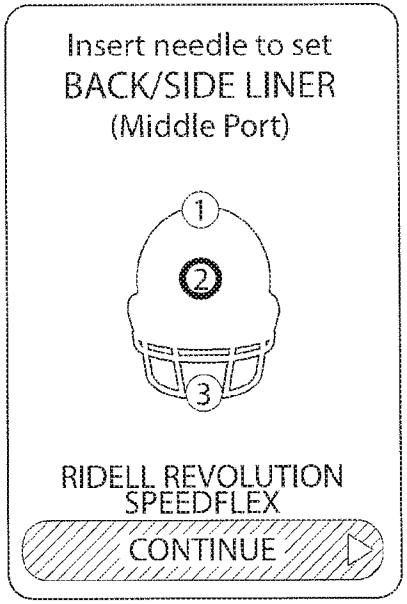
Figure 7F:
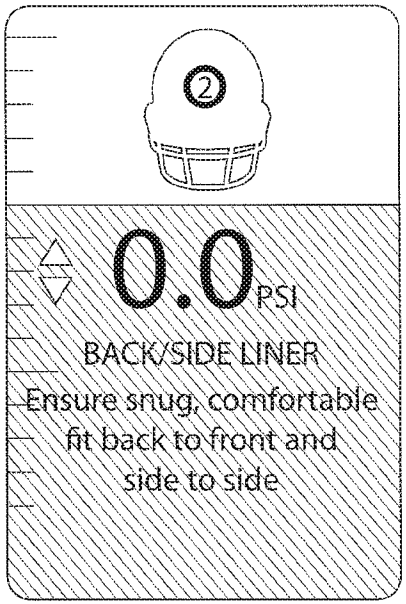
Figure 7G:
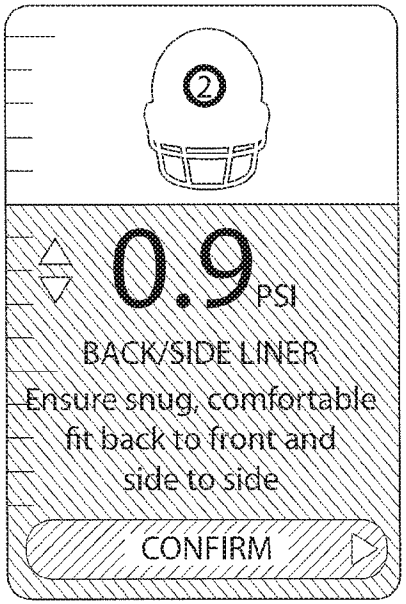
Figure 7H:
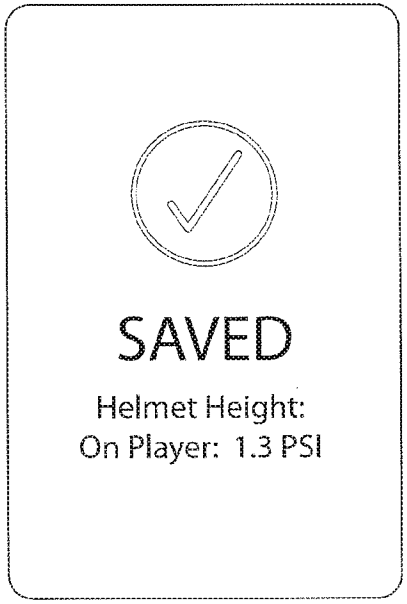
Figure 7I:
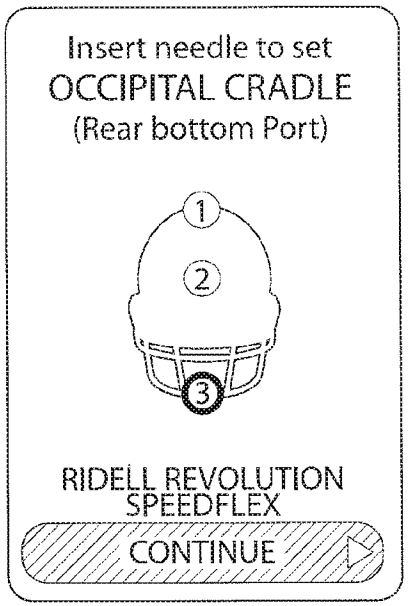
Figure 7J:
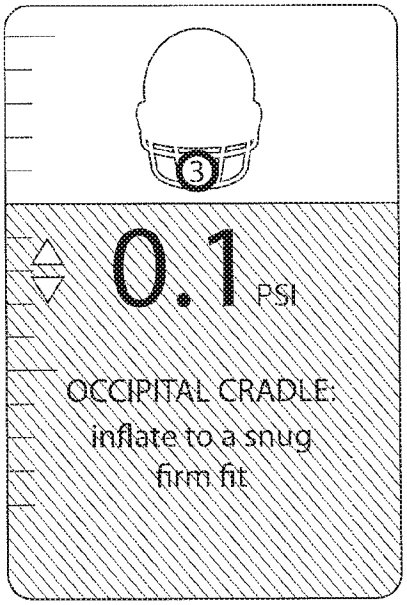
Figure 7K:
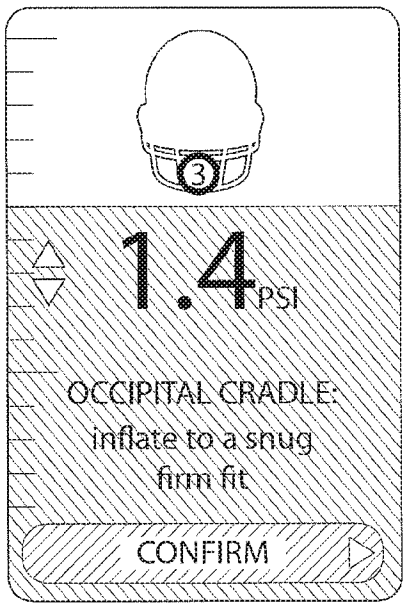
Figure 7L:
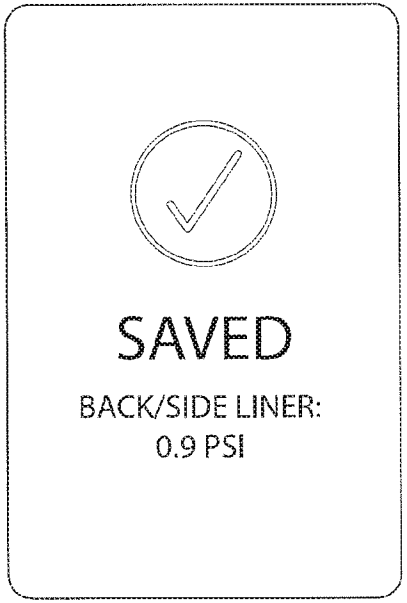
Figure 7M:
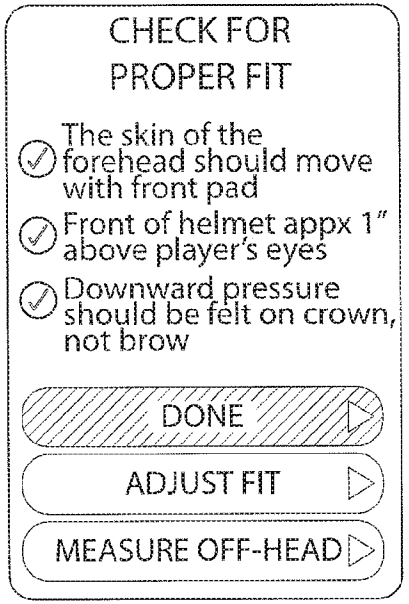
Figure 7N:
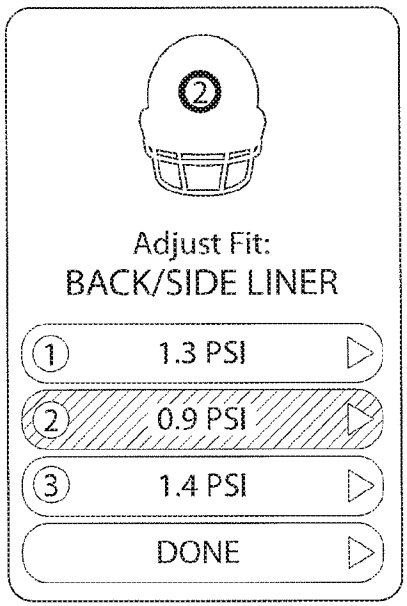
Figure 7O:
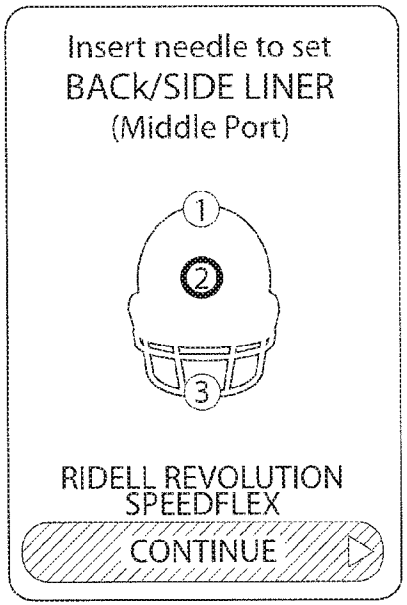
Figure 7P:
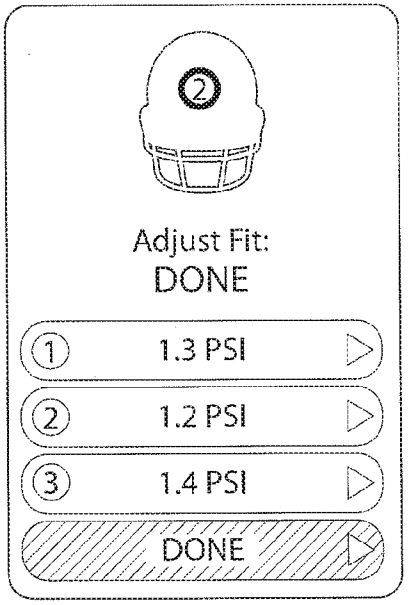
Figure 7R:
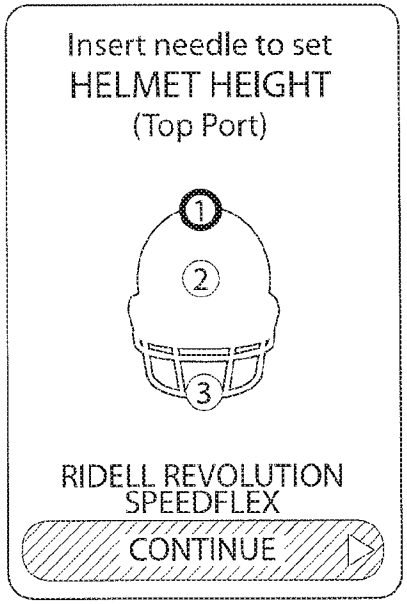
Figure 7Q:
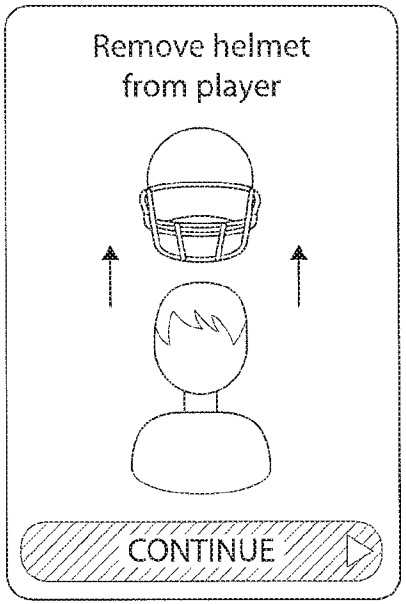
Figure 7U:
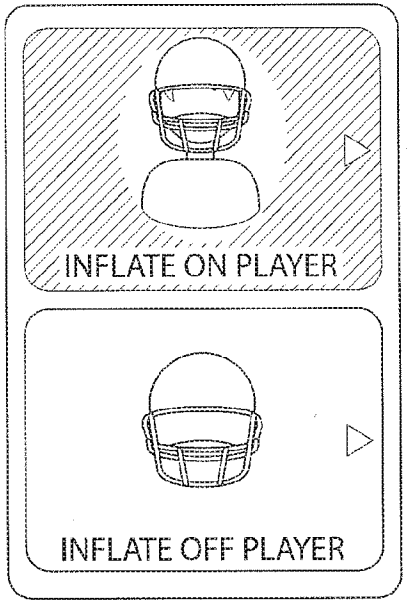
Figure 7T:
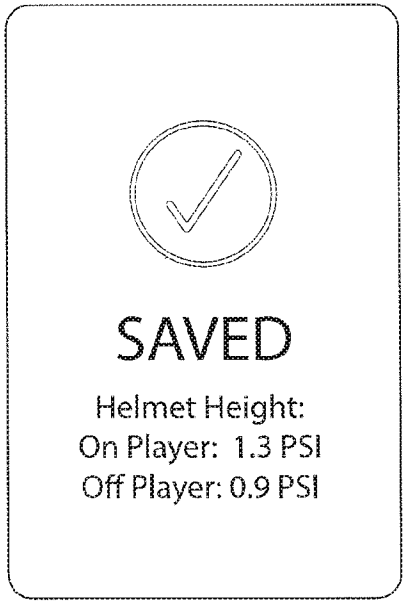
Figure 7S:
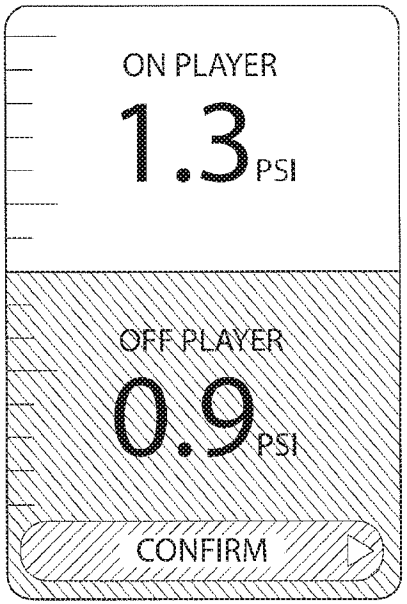
Figure 7V:
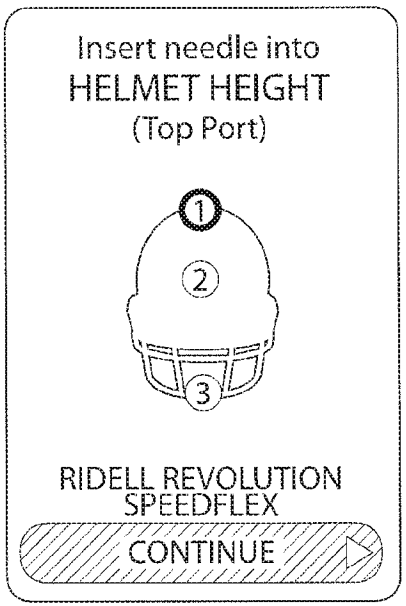
Figure 7W:
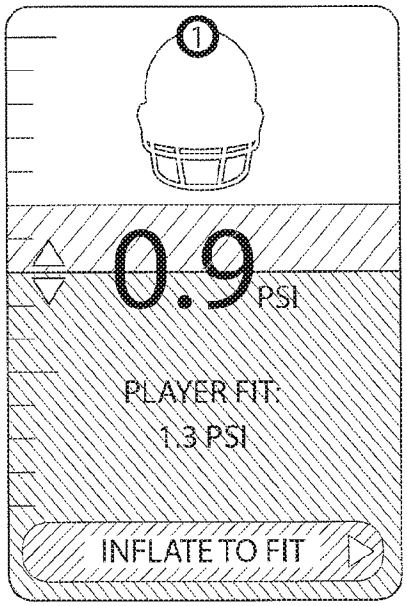
Figure 7X:
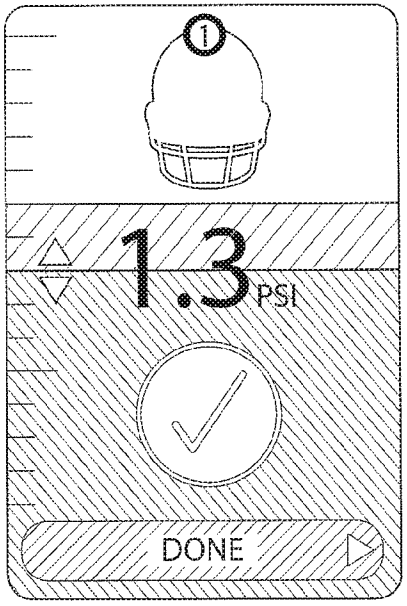
Figure 7Y:
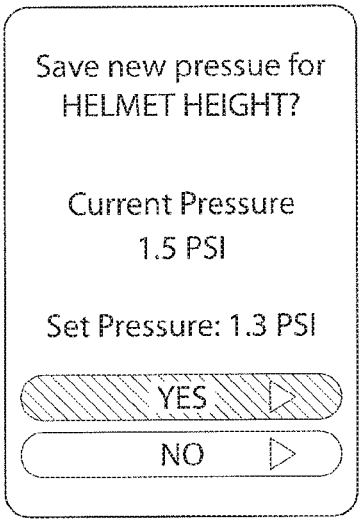
Figure 7Z:
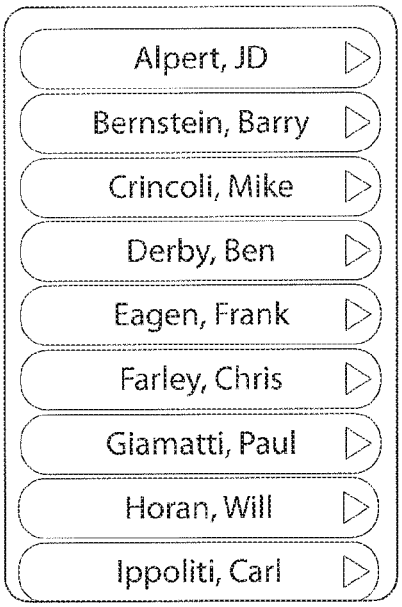

It should be noted that in FIGS. 7-7Z where a virtual button is shown with hatched indicia, this means that the user has selected that particular virtual button.

When the player has been given his football helmet and he/she is present with the operator, the player places his helmet on and the operator attaches the wireless device 124 within the cradle 122B. The device 124 is turned on and communication with the pump 122 is verified by the operator. The operator unwraps the cord and lubricates the inflation needle 122E. The operator then selects the particular player that is present (FIG. 7) and selects the Fit Helmet module 602. This action then prompts the operator to insert the needle into the indicated air bladder valve/port, as shown in FIG. 7A. Once the inflation needle 122E is inserted, the device 124 display indicates the current pressure in that air bladder (FIG. 7B), along with accompanying guidance as to how the related portion of the helmet should be optimally positioned if that particular air bladder is optimally filled. It should be noted that the displayed pressure (viz., 0.2 PSI) is PSI gauge pressure for consistent user experience (no variation with altitude). The user then uses the "up/inflate" hard key (FIG. 2C) or the "down/deflate" hard key to adjust the displayed pressure until that particular air bladder is filled to its proper level (FIG. 7C); or, alternatively, where the virtual keys 122C' are active in the display 124A/402, the appropriate virtual keys are used. This can be achieved by asking the player "how it feels" and depending on whether the player responds "too loose" or "too tight" the operator can use the UP/INFLATE key or the DOWN/INFLATE keys (FIG. 2C) on the keypad 122C (or virtual keys 122C') to adjust the gas pressure level to the preferred level. It should be noted that by pressing and holding either key a continuous inflation or deflation is provided, whereas a momentary activation of either key results in an interval inflation or deflation. If the inflation level is satisfactory to the player, the operator selects the option of "confirm" and that air bladder's proper inflation level (HP level, meaning "head pressure level" in that the proper pressure level is set with the player wearing the helmet) is now set in the wireless device 124, indicated as shown in FIG. 7D. Once confirmed, the module 602 then sends the operator to the next air bladder valve or port as shown in FIG. 7E. The operator then removes the inflation needle 122E from the air bladder valve of FIG. 7A and inserts it into the air bladder valve indicated in FIG. 7E. The operator then goes through the same series of steps as shown in FIGS. 7F-7H to save the HP level setting for the second air bladder. Once this last air bladder HP level is stored, the operator removes the inflation needle from that valve 3. The Fit Helmet Module 602 then brings the operator to the last air bladder valve/port, as shown in FIG. 7I. The operator then removes the inflation needle 122E from the second port and inserts it into the third air bladder valve/port as instructed in FIG. 7I. Again, the operator then goes through the same steps as shown in FIGS. 7J-7L. Once the HP level setting for the last air bladder is set, the Fit Helmet Module 602 allows the operator several options (FIG. 7M) at this point. The operator can exit the module 602 altogether and move to the next player; or, the operator can go back and adjust a HP level for a particular air bladder (via the Adjust Fit module 604) without having to go through each air bladder again; or, the operator can move to another option: Measure Off-Head module 606.

Adjust Fit Module 604

After removing the inflation needle 122E from the last air bladder valve 3, the operator can physically manipulate the helmet 1 on the player's head to verify a proper fit. If the fit is good, the operator selects the "done" button (FIG. 7M) and moves to the next player. However, if the manipulation has the operator or player requiring a further adjustment of a particular air bladder HP level, the operator can select the "Adjust Fit" virtual button (FIG. 7M) which brings the operator to a menu (FIG. 7N) that allows the operator to select one of the air bladders to operate on. By way of example only, the operator has chosen to revisit the second air bladder in FIG. 7N. The operator is then brought to the display shown in FIG. 7O instructing the operator to insert the inflation needle 122E in the appropriate air bladder valve/port. At that point, the operator goes through a process similar to the one in the Fit Helmet Module 602, discussed above. Once the new HP level setting (e.g., 1.2 PSI) is saved, the operator is brought to a completion display (FIG. 7P). At that point, the operator removes the inflation needle 122E from that air bladder valve/port and the device 124 display returns to FIG. 7M.

Measure Off-Head Module 606

Once all of the HP level values are set in every air bladder of a particular helmet, the operator can select the Measure Off-Head Module 606. This module allows the operator to measure the air pressure in each bladder with the helmet removed from the player. As can be appreciated, with the helmet removed, the air pressure in each air bladder will be slightly reduced than when it was being worn. This off-head pressure (OHP) level can be stored and associated with the previously-stored HP level when the helmet was worn. As such, if the helmet air bladders need to be re-inflated when the player is not available, the operator can inflate each bladder to the associated OHP level. Because this module is only detecting an OHP level, all inflation/deflation keys are not active to the operator.

In particular, FIGS. 7Q-7T show the sequence of displays on the wireless device 124 (or display 402) that are occur as the operator moves through the Measure Off-Head module 606. As can be seen in FIG. 7Q, the operator removes the helmet from the player and is instructed to insert the inflation needle 122E into a particular air bladder valve/port. Once inserted, the OHP level is displayed below the associated HP level when the helmet is worn. Once this OHP level is confirmed, the operator is moved to the next air bladder and the procedure is repeated until an OHP level is associated with every air bladder in the helmet.

Inflate Helmet Module 608

Once both the HP level and its associated OHP level are stored for each air bladder in every player's helmet, any subsequent or periodic checking and maintenance of the air bladder pressure levels can be implemented using the Inflate Helmet module 608. This can be accomplished with the player wearing the helmet or without the player wearing the helmet. In particular, by selecting this Inflate Helmet module 608, the device 124 displays the choice shown in FIGS. 7U-7V. If the operator selects the option "Inflate on Player", the operator is instructed to insert the inflation needle 122E in the proper air bladder valve/port and goes through the shown in FIGS. 7W-7X. As shown by the center display in FIGS. 7W-7X, when the inflation needle 122E is inserted into the top port, the currently-detected HP level is only 0.9 PSI, which below the previously-stored HP level of 1.3 PSI. The operator need only select the "Inflate to Fit" button and the pump 122 automatically restores that air bladder to the proper HP level. It should be noted that if, for some reason, the player wants to change the proper HP level at that point, instead of selecting the "Done" button in the display of FIG. 7X, the operator can use the hard keys on the keypad 122C to adjust the HP level up or down, accordingly. By doing so, the device 124 then displays what is shown in FIG. 7Y, allowing the operator to save a new HP level. Therefore, after operator either selects the "Done" button, or alternatively, saves a new HP level, the user is stepped through the other air bladder valve/port maintenance in accordance with what was just described for the first air bladder valve/port until all the air bladders for that helmet are checked.

If, on the other hand, the operator selects the "Inflate Off Player" selection (FIG. 7U) in the Inflate Helmet module 608, the same sequence of displays are provided as shown in FIGS. 7W-7X. However, the option of FIG. 7Y is not available in the "Inflate Off Player" selection because the player is not wearing the helmet. As such, the up/inflate and down/deflate keys are not active in this mode. Thus, using the "Inflate Off Player" selection, only permits the operator to refill each air bladder in accordance with the previously-stored OHP levels.

Once the HP levels/OHP levels are established for a particular player's helmet, or where the subsequent check/maintenance of that player's helmet is completed, the software application moves the display on the wireless device 124 (or display 402) to the next player in the team roster, as shown in FIG. 7Z.

The software application implements a time and date stamp for each use of the various functional modes 602-608 and various analytics can be performed by the software application, e.g., how much air was released between each measurement and variables such as time, weather, ambient air pressure can be used to even predict when refills may need to be done.

The software application can be programmed to provide the user with reminders of when to check the various players' helmets' air bladders.

As mentioned earlier, the air bladder data can be transmitted to a remote database 1000 which comprises the database itself 1000B via wireless communication link 1002. In particular, players' air bladder helmet data is transmitted via a wireless signal 1002 to the remote database 1000A. Similarly, the data can be recalled from the remote database 1000A when required, such as for carrying out a re-inflation of the teams' helmets. As a result, the remote database 1000A acts as a remote storage, similar to the function of the iCloud® database. Furthermore, the remote database 1000A comprises a greater processing power to support more complex analyses than is resident in the software application on the wireless device 124; as such, the remote database 1000A can carry out the analyses and then transmit that analyzed data back to the wireless device 124. For example, the remote database 1000A can also conduct analytics on the air bladders of the helmets on the overall team, not just for individual players, and then provide the operator with customized adjust fit helmet module 604 implementations. For example, the collected data may have special teams not requiring air bladder checks as often as defensive linemen or offensive linemen.

Figure 8:
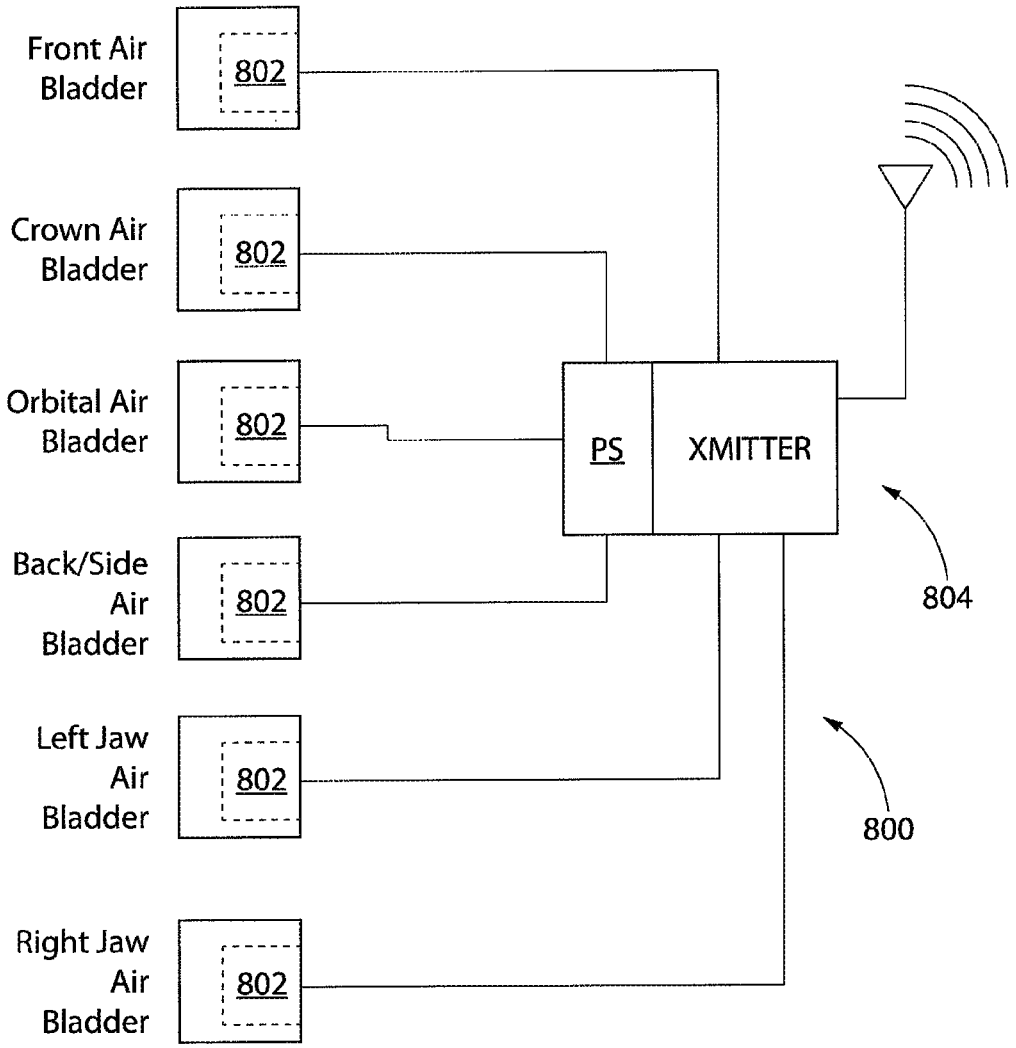
FIG. 8 depicts a pressure sensor configuration within the helmet itself for periodically reporting instantaneous pressure levels within each air bladder.

An even further variation 800 (FIG. 8) on the present invention is the positioning of respective pressure sensors 802 within each bladder of the helmet 1 that transmit pressure data on a frequent basis to a remotely located receiver (e.g., the wireless device 124, or pump 400). In particular, a pressure sensor 802 is located within each helmet bladder. The pressure sensors 802 are coupled to a power supply PS (e.g., battery) within the helmet 1 along with a transmitter 804. The pressure sensors provide respective pressure levels within each air bladder to the transmitter 804 which then transmits the air bladder data on a regular basis. The wireless device 124, upon receiving this data, alerts the user with visual and or audible warnings. The user can then plan to take appropriate actions to refill particular bladders when the opportunity permits and in accordance with procedures discussed above.

It should also be understood that the Specification makes reference to air pressure sensors and helmet bladders being filled with air. It is within the broadest scope of the present application to include any other type of gas that is used to fill these bladders and that air is being used by way of example only.

It should be noted that the hose 122D/inflation needle 122E and the needle 325 each form a "coupling means" which is meant to cover any known way of pneumatically coupling the electronic pumps 122A, 322A, 404 to the helmet valve 3.

While the invention has been described in detail and with reference to specific examples thereof, it will be apparent to one skilled in the art that various changes and modifications can be made therein without departing from the spirit and scope thereof.

What is claimed is:

1. A system for establishing and maintaining gas pressure levels within a plurality of gas bladders of a sports helmet, said system comprising:

an electronically-controlled pneumatic pump including a communication interface and a gas pressure sensor, said pump further comprising coupling means for connecting to valves of said plurality of gas bladders;

a wireless device that communicates with said electronically-controlled pneumatic pump, said wireless device further comprising a display for permitting an operator to control the operation of said pump via said wireless device to measure a gas pressure of each bladder, establish a respective preferred gas pressure level within each bladder and to periodically restore gas pressure in each bladder to its preferred gas pressure level, said wireless device storing said respective preferred gas pressure levels for said helmet; and wherein said wireless device comprises a user interface, said user interface generating a spreadsheet of a sports team's players that associates preferred gas bladder preferred levels for each bladder in each team player's helmet, said spreadsheet including time and date stamps.

2. The system of claim 1 wherein said electronically-controlled pneumatic pump further includes a wireless communication interface for communicating with said wireless device.

3. The system of claim 2 wherein said wireless device reminds an operator to periodically check the gas pressure levels in each bladder of said helmet.

4. The system of claim 2 wherein said respective preferred gas pressure level for each bladder comprises a first gas pressure level indicative of a preferred gas pressure when the helmet is worn by a player and a second gas pressure level indicative of a preferred gas pressure when the helmet is not being worn by the player.

5. The system of claim 2 wherein said electronically-controlled pneumatic pump is hand-held having a keypad having keys whose keys reconfigure for left-handed or right-handed operator use.

6. The system of claim 5 wherein said electronically-controlled pneumatic pump further comprises an adjustable device cradle for receiving one of a plurality of differently-sized wireless devices therein.

7. The system of claim 6 wherein said coupling means comprises a hose and inflation needle that connects to the valve and wherein said cradle comprises a reverse side having hose hooks for stowing said hose thereagainst.

8. The system of claim 2 further comprising a remotely-located database, said wireless device transmitting said pressure data to said remotely-located database for retrieval at a subsequent time.

9. The system of claim 1 wherein said electronically-controlled pneumatic pump further includes a wired communication interface for communicating with said wireless device.

10. A method for establishing and maintaining air pressure levels within a plurality of gas bladders of a sports helmet, each bladder having a respective valve, said method comprising:

(a) providing an electronically-controlled pneumatic pump including a gas pressure sensor and further including coupling means for connecting to valves of the plurality of gas bladders;

(b) positioning a wireless device, having a display, in close proximity to said electronically-controlled pneumatic pump to establish communication between said pump and said wireless device;

(c) activating a user interface on said wireless device for identifying the sports helmet whose gas bladders are to be monitored or filled and to associate said selected helmet with a respective player;

(d) coupling said coupling means to a particular one of said plurality of valves instructed by said user interface;

(e) operating said pump, via said user interface, to establish a preferred gas pressure level within said one of said plurality of gas bladders; and (f) storing said preferred gas pressure level of said one of said plurality of bladders within said wireless device in a spreadsheet in said user interface by associating said preferred gas pressure level with said particular bladder, player and helmet along with a date and time of said operating said pump.

11. The method of claim 10 wherein said step of providing electronically-controlled pneumatic pump comprises including a wireless communication interface within said pump so that said electronically-controlled pneumatic pump can wirelessly communicate with said wireless device.

12. The method of claim 11 further comprising the steps of:

(g) disconnecting said coupling means from said one of said plurality of valves; and (h) repeating steps (d)-(f) for each of the remaining ones of said plurality of gas bladders.

13. The method of claim 11 further comprising the step of periodically checking a gas pressure level in one of said plurality of bladders of said sports helmet by:

(g) coupling said coupling means to said particular one of said plurality of valves instructed by said user interface;

(h) comparing a detected bladder gas pressure level against said preferred gas pressure level of said one of said plurality of gas bladders;

(i) controlling said pump to establish said preferred gas pressure level in said one of said plurality of gas bladders;

(j) storing a time and date of said checking of said one of said plurality of gas bladders and associating said time and date of said checking with said player and his or her helmet in said spreadsheet; and (k) disconnecting said coupling means from said one of said plurality of valves; and (l) repeating steps (g)-(j) for each of the remaining ones of said plurality of gas bladders.

14. The method of claim 11 further comprising the step of reminding an operator to periodically check the gas pressure levels in each bladder of said helmet.

15. The method of claim 11 wherein said step of operating said pump, via said user interface, to establish said preferred gas pressure level within said one of said plurality of gas bladders comprises a first gas pressure level indicative of a preferred gas pressure when the helmet is worn by a player and a second gas pressure level indicative of a preferred gas pressure when the helmet is not being worn by the player.

16. The method of claim 11 wherein said step of providing said electronically-controlled pneumatic pump comprises providing a hand-held electronically-controlled pneumatic pump having a keypad having keys and whose keys reconfigure for left-handed or right-handed operator use.

17. The method of claim 16 wherein said step of positioning said wireless device comprises disposing said wireless device within an adjustable device cradle coupled to said pump.

18. The method of claim 12 further comprising the step of transmitting said preferred gas pressure levels to a remotely-located database for retrieval at a subsequent time.

19. The method of claim 12 wherein said step of providing an electronically-controlled pneumatic pump comprises including a wired communication interface within said pump so that said electronically-controlled pneumatic can communicate over a wired connection with said wireless device.

* * * * *